US009351615B2

(12) United States Patent
Williams et al.

(10) Patent No.: US 9,351,615 B2
(45) Date of Patent: May 31, 2016

(54) TOILET CADDY ASSEMBLY AND METHOD OF FORMING A TOILET CADDY ASSEMBLY

(71) Applicant: S.C. Johnson & Son, Inc., Racine, WI (US)

(72) Inventors: Neil P. Williams, Racine, WI (US); Christopher Conley, Kenosha, WI (US); Jo Anthony Sasota, Milwaukee, WI (US); Chrysoula Myrto Nigl, Highland Park, IL (US); Heather Harwood, Oak Creek, WI (US); Christopher Alan Harris, Madison, WI (US); Christopher T. Strahm, Deforest, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 14/338,679

(22) Filed: Jul. 23, 2014

(65) Prior Publication Data

US 2015/0027914 A1 Jan. 29, 2015

Related U.S. Application Data

(60) Provisional application No. 61/857,544, filed on Jul. 23, 2013.

(51) Int. Cl.

| | |
|---|---|
| ***A47K 17/00*** | (2006.01) |
| ***B65D 85/00*** | (2006.01) |
| ***A47K 11/10*** | (2006.01) |

(52) U.S. Cl.

CPC ..... *A47K 17/00* (2013.01); *A47K 11/10* (2013.01); *B65D 85/00* (2013.01)

(58) Field of Classification Search

CPC ..... A47K 17/00; A47K 11/10; A47K 11/105; B65D 85/00

USPC ..... 206/223, 15.3, 361, 15.2, 362.2, 581, 206/362, 373; 15/209.1, 210.1, 114, 104.94

See application file for complete search history.

(56) References Cited

U.S. PATENT DOCUMENTS

| | | | |
|---|---|---|---|
| D211,842 | S | 7/1968 | Vilegi |
| 3,463,353 | A | 8/1969 | Peebles |

(Continued)

FOREIGN PATENT DOCUMENTS

| | | |
|---|---|---|
| CN | 3339549 | 12/2003 |
| CN | 3377133 | 7/2004 |

(Continued)

OTHER PUBLICATIONS

PCT/US2014/047750 International Search Report and Written Opinion dated Oct. 15, 2014.

*Primary Examiner* — Steven A. Reynolds

(57) ABSTRACT

A storage caddy for a cleaning implement can include a holder configured to receive a wand or cleaning implement and a storage container having a lid connected to the storage container. The storage caddy can also include a tray for holding a first set of cleaning pads and a sleeve for holding a second set of cleaning pads. The first set of cleaning pads can be arranged in an upper portion of the storage container above the second set of cleaning pads, and the second set of cleaning pads can be located in a lower portion of the storage container. The wand or cleaning implement can be configured to receive one of the first set of cleaning pads from the tray or one of the second set of cleaning pads from the sleeve.

20 Claims, 23 Drawing Sheets

(56) References Cited

U.S. PATENT DOCUMENTS

| | | | | |
|---|---|---|---|---|
| 4,031,673 | A * | 6/1977 | Hagelberg | A47K 11/10 15/104.94 |
| D255,094 | S | 5/1980 | Wright | |
| D272,874 | S | 3/1984 | Cohen | |
| D297,292 | S | 8/1988 | Plymale | |
| D298,712 | S | 11/1988 | Mattei | |
| D307,967 | S | 5/1990 | Lanius | |
| D309,971 | S | 8/1990 | Quong | |
| 4,987,634 | A | 1/1991 | Weihrauch | |
| D329,561 | S | 9/1992 | Nyorkor | |
| D343,713 | S | 1/1994 | Barber | |
| D364,039 | S | 11/1995 | Kruger | |
| 5,488,748 | A * | 2/1996 | Koch | A47L 25/00 15/104.94 |
| D413,419 | S | 8/1999 | Arbak et al. | |
| D414,064 | S | 9/1999 | Shafik | |
| D421,169 | S | 2/2000 | Demore et al. | |
| D425,744 | S | 5/2000 | McGuire | |
| 6,094,771 | A * | 8/2000 | Egolf | A47K 11/00 15/210.1 |
| D439,085 | S | 3/2001 | Quinn | |
| D446,063 | S | 8/2001 | Quinn | |
| 6,295,688 | B1 * | 10/2001 | Sayles | A47K 11/10 15/104.94 |
| D450,964 | S | 11/2001 | Johnson | |
| 6,507,972 | B2 | 1/2003 | Hart | |
| D471,393 | S | 3/2003 | Hutchinson | |
| D477,483 | S | 7/2003 | Brown et al. | |
| 6,611,986 | B1 * | 9/2003 | Seals | A47K 11/10 15/210.1 |
| D482,920 | S | 12/2003 | Libman et al. | |
| D483,164 | S | 12/2003 | Lin | |
| D484,292 | S | 12/2003 | Lin | |
| 6,692,091 | B2 | 2/2004 | Mulaw | |
| D488,902 | S | 4/2004 | Yang et al. | |
| 6,726,010 | B2 | 4/2004 | Kaminstein | |
| D491,404 | S | 6/2004 | Dotterman et al. | |
| 6,745,427 | B1 * | 6/2004 | Trenz | A46B 7/04 15/104.94 |
| D493,590 | S | 7/2004 | Chen | |
| D493,994 | S | 8/2004 | Belt et al. | |
| D495,182 | S | 8/2004 | Vitantonio et al. | |
| D496,512 | S | 9/2004 | Treacy | |
| D500,223 | S | 12/2004 | Libman et al. | |
| D500,618 | S | 1/2005 | Nagoya | |
| D501,347 | S | 2/2005 | Conway et al. | |
| D501,728 | S | 2/2005 | Conway et al. | |
| D502,002 | S | 2/2005 | Conway et al. | |
| D502,324 | S | 3/2005 | Soller et al. | |
| D504,065 | S | 4/2005 | Belser et al. | |
| D516,895 | S | 3/2006 | Minkler et al. | |
| 7,032,270 | B2 | 4/2006 | Vitantonio et al. | |
| D520,852 | S | 5/2006 | Minkler et al. | |
| 7,044,299 | B2 | 5/2006 | Nagoya | |
| 7,059,008 | B2 | 6/2006 | Morgan et al. | |
| 7,065,825 | B2 | 6/2006 | Minkler et al. | |
| D525,467 | S | 7/2006 | Michelson et al. | |
| D528,333 | S | 9/2006 | Wildauer et al. | |
| D532,564 | S | 11/2006 | Neumann et al. | |
| 7,159,265 | B2 | 1/2007 | Soller et al. | |
| D538,537 | S | 3/2007 | Osborn | |
| D539,499 | S | 3/2007 | Yang et al. | |
| 7,213,706 | B2 | 5/2007 | Belser et al. | |
| 7,225,925 | B2 | 6/2007 | Chen et al. | |
| D547,987 | S | 8/2007 | Yang et al. | |
| D552,816 | S | 10/2007 | Cybulski et al. | |
| 7,287,295 | B2 * | 10/2007 | Treacy | A46B 7/04 15/209.1 |
| D559,495 | S | 1/2008 | Yang et al. | |
| D560,630 | S | 1/2008 | Mitchell et al. | |
| 7,316,046 | B2 | 1/2008 | Michaels et al. | |
| D561,473 | S | 2/2008 | Phillips et al. | |
| D566,922 | S | 4/2008 | Lee | |
| D569,105 | S | 5/2008 | Van Hoorn | |
| D575,086 | S | 8/2008 | Savran | |
| D578,266 | S | 10/2008 | Yang et al. | |
| D578,268 | S | 10/2008 | Yang et al. | |
| D588,365 | S | 3/2009 | Conway et al. | |
| D589,734 | S | 4/2009 | Weis et al. | |
| D595,468 | S | 6/2009 | Liao | |
| D596,820 | S | 7/2009 | Yang et al. | |
| 7,581,276 | B2 | 9/2009 | Endo et al. | |
| D603,119 | S | 10/2009 | Yang et al. | |
| 7,650,663 | B2 | 1/2010 | Michaels et al. | |
| 7,669,715 | B2 | 3/2010 | Wang | |
| 7,827,648 | B2 | 11/2010 | Soller et al. | |
| D629,635 | S | 12/2010 | Raven | |
| D632,490 | S | 2/2011 | Cobabe et al. | |
| D632,491 | S | 2/2011 | Lowe et al. | |
| 7,900,287 | B2 * | 3/2011 | Wildauer | E03C 1/308 4/255.11 |
| D636,960 | S | 4/2011 | Duvigneau | |
| 7,958,590 | B2 | 6/2011 | Trefethren et al. | |
| 7,984,820 | B2 | 7/2011 | Dancyger | |
| D644,390 | S | 8/2011 | Smeets et al. | |
| 8,056,754 | B2 | 11/2011 | Stoner | |
| D649,786 | S | 12/2011 | Lipfert et al. | |
| D652,189 | S | 1/2012 | Morand | |
| D660,630 | S | 5/2012 | Soller et al. | |
| 8,286,295 | B2 | 10/2012 | Minkler et al. | |
| D672,591 | S | 12/2012 | Soller et al. | |
| D688,589 | S | 8/2013 | Hung et al. | |
| D688,870 | S | 9/2013 | Levie | |
| D702,440 | S | 4/2014 | Williams et al. | |
| D702,457 | S | 4/2014 | Williams et al. | |
| D702,458 | S | 4/2014 | Williams et al. | |
| D702,943 | S | 4/2014 | Williams et al. | |
| 2002/0007527 | A1 * | 1/2002 | Hart | A47K 11/10 15/104.94 |
| 2002/0083542 | A1 * | 7/2002 | Hart | A47K 11/10 15/210.1 |
| 2004/0149608 | A1 | 8/2004 | Laux et al. | |
| 2006/0225237 | A1 * | 10/2006 | Gartland | A47K 11/10 15/210.1 |
| 2007/0089224 | A1 | 4/2007 | Wildauer et al. | |
| 2007/0186365 | A1 | 8/2007 | Armaly | |
| 2007/0245508 | A1 | 10/2007 | Gartland | |
| 2008/0029415 | A1 | 2/2008 | Wang | |
| 2009/0152132 | A1 * | 6/2009 | Wang | A47K 11/10 206/15.3 |
| 2009/0249572 | A1 | 10/2009 | Minkler et al. | |
| 2010/0275398 | A1 | 11/2010 | Peterlin | |
| 2014/0251844 | A1 * | 9/2014 | Michelson | A47K 17/00 206/362.3 |

FOREIGN PATENT DOCUMENTS

| | | | |
|---|---|---|---|
| CN | 3391656 | | 9/2004 |
| DE | 102011000922 | A1 | 8/2012 |
| EM | DM/079063 | | 4/2012 |
| EP | 001752221-0001 | | 9/2010 |
| EP | 001311153-0001 | | 1/2012 |
| EP | 001311153-0002 | | 1/2012 |
| EP | 000748041-0001 | | 6/2012 |
| EP | 001335293-0001 | | 7/2012 |
| EP | 000911755-0001 | | 4/2013 |
| GB | 2402605 | A | 12/2004 |
| JP | D1190920 | | 10/2003 |
| WO | WO87/00022 | A1 | 1/1987 |
| WO | 0071012 | A1 | 11/2000 |
| WO | 0108535 | A1 | 2/2001 |
| WO | 2004100744 | A1 | 11/2004 |
| WO | 2007054696 | A1 | 5/2007 |
| WO | D075540-017 | | 1/2011 |

* cited by examiner

TOILET CADDY ASSEMBLY AND METHOD OF FORMING A TOILET CADDY ASSEMBLY

This application claims priority to U.S. Provisional Application No. 61/857,544 filed on Jul. 23, 2013, which is incorporated herein fully by reference.

FIELD

The present disclosure relates generally to toilet caddy assemblies for a cleaning implement and cleaning supplies.

BACKGROUND

Toilet brushes are typically used to swirl cleaning chemicals around a toilet bowl, and then to scrub the sides of the bowl with chemicals or water, so as to assist in removing stains along the toilet bowl sides. Typically, such brushes have their brush bristles permanently affixed to the handle of the brush.

After using such a brush, a consumer will attempt to rinse off the brush by swirling it in bowl water. In some cases this rinsing process will be repeated through several rinsing flushes. While this rinses off most of the cleaning chemicals, feces, urine, and stray bits of paper typically found in the toilet, the brush still normally retains some contaminants even after extensive rinsing. As a result, the brush may develop an unpleasant smell or appearance during storage.

Regardless of whether contaminating materials are present on the stored brush, the brush will be dripping wet immediately after it is used. The consumer may therefore try to shake the brush over the toilet to try to remove most of the excess water, and then quickly move the brush over and into a storage bucket or the like. This can result in some dripping of liquid on the floor as the wet brush is moved from above the bowl to a bucket or similar storage container. In any event, this requires a consumer to obtain and find a storage place for the bucket or storage container.

SUMMARY

This Summary provides an introduction to some general concepts relating to this disclosure in a simplified form that are further described below in the Detailed Description. This Summary is not intended to identify key features or essential features of the invention.

Aspects of the disclosure herein relate to a storage caddy for a cleaning implement and a method of providing the storage caddy. In one aspect, the storage caddy can be arranged such that the user can fill a cleaning implement or wand with a fresh cleaning pad and dispose of the cleaning pad without directly touching or handling the cleaning pad to provide a "touchless" cleaning system. The storage caddy can include one or two sets of cleaning pads, for example, one set of cleaning pads can be designed for "touch-up" cleaning, and the other set of pads can be designed for a deep cleaning. The pads can be designed to be disposable, and at least one set of the pads can be designed to be flushable. In addition or alternatively, the storage caddy or receptacle can include a cleaning material alone or in conjunction with one or more sets of cleaning pads.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1B:
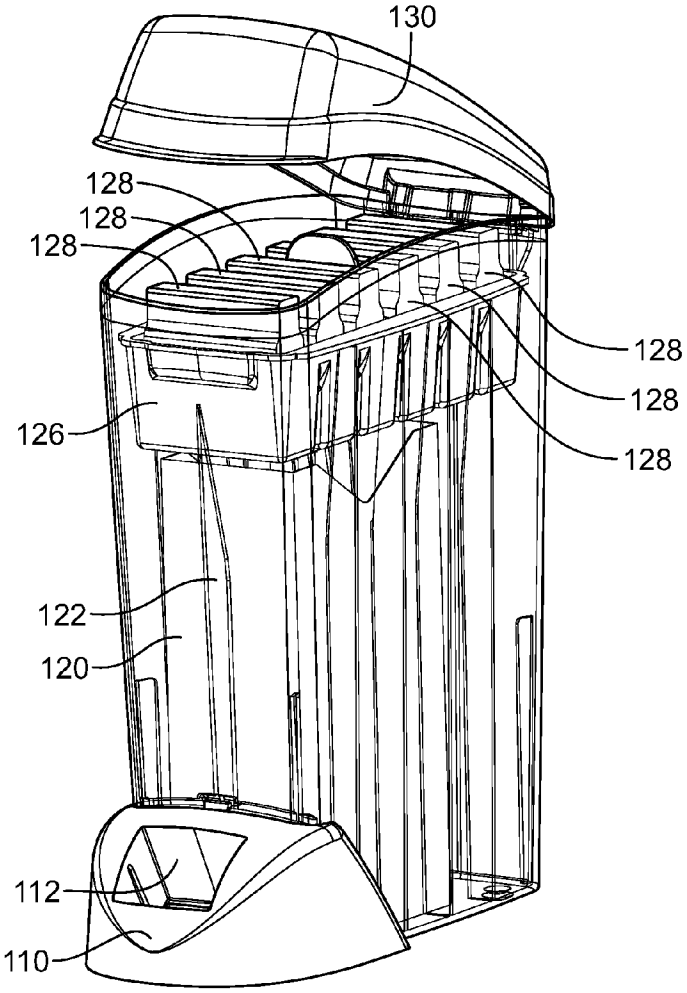
FIG. 1B shows a front perspective view of the example storage caddy in FIG. 1A with portions drawn transparent for illustrative purposes.
Figure 1A:
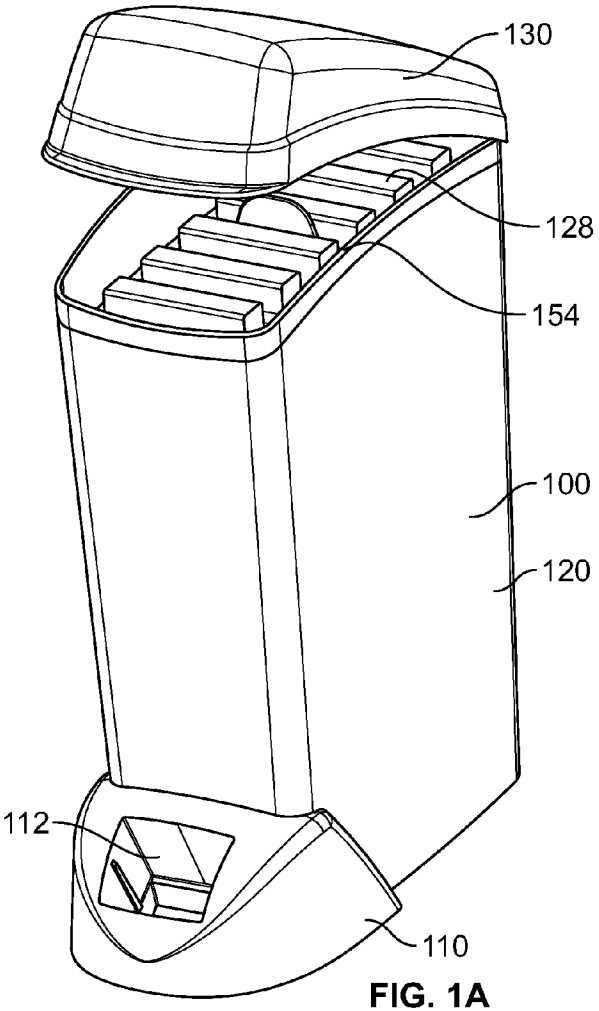
FIG. 1A shows a front perspective view of an example storage caddy in accordance with an aspect of the disclosure.

In the following description of the various examples and components of this disclosure, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and methods without departing from the scope of the present invention.

Also, while the terms "upper," "lower," "top," "bottom," "front," "back," "rear," "side," "forward," "rearward," and "backward" and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the invention.

FIGS. 1A-1G depict an exemplary storage caddy 100 for a cleaning implement and cleaning materials. The storage caddy 100 generally includes a base or holder 110 connected thereto for holding a wand 140 (shown in FIG. 4) and a storage container 120 for housing cleaning materials, e.g., toilet gels, refills, cleaning pads, etc. The storage container 120 can also include a lid 130 connected to the container 120 for at least partially covering the storage container storage receptacle 120. The lid 130 can be selectively moveable between an open first position and a closed second position by a hinge 124 or other suitable connection such that during use, the user can open the lid 130 and access cleaning pads 128, 134 located in the storage container 120 with the wand 140. The base or holder 110 can include an opening or slot 112 that is shaped to receive and hold a correspondingly shaped head 142 of the wand 140.

Figure 1D:
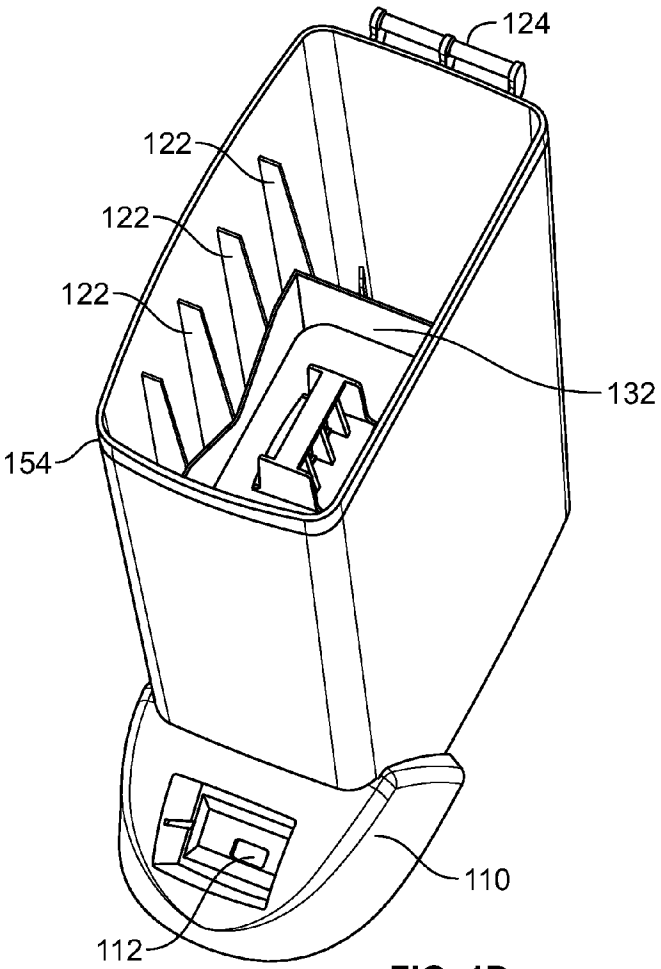
FIG. 1D shows a top perspective view of the example storage caddy of FIG. 1A with a lid and tray removed.
Figure 1C:
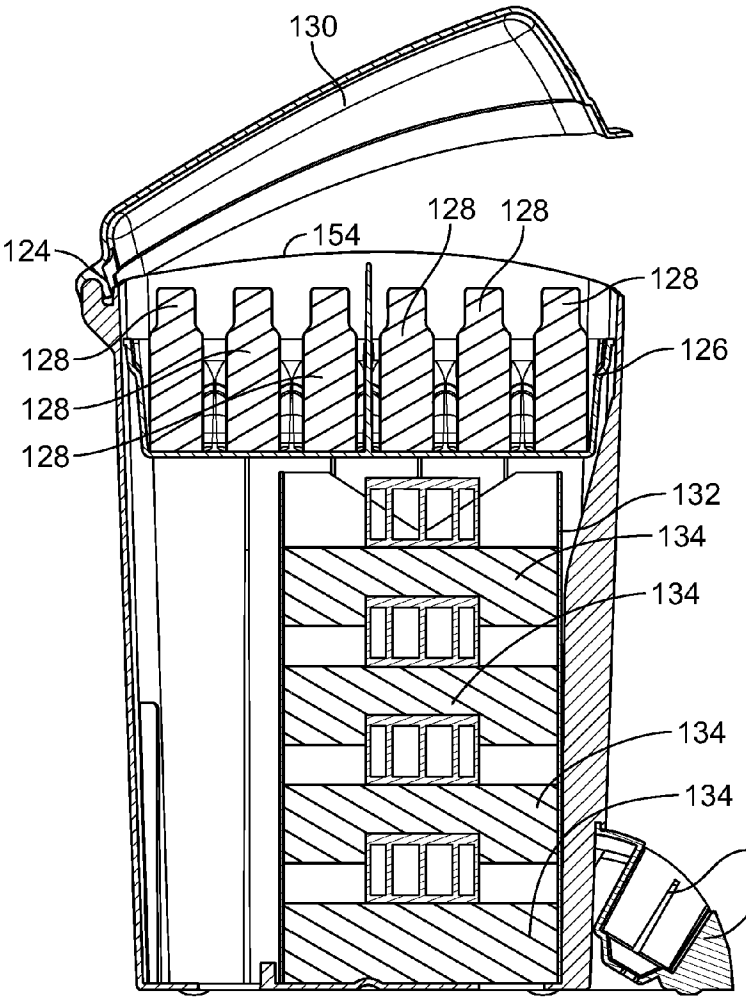
FIG. 1C shows a cross-sectional side view of the example storage caddy of FIG. 1A.

FIG. 1B is drawn transparent, and FIG. 1C is a cross sectional view to illustrate the arrangement of the internal components of the storage container 120. The storage container 120 can define a storage receptacle configured to receive cleaning pads associated with the cleaning implement and at least one additional cleaning material. In particular, a first set, array or tier of cleaning pads 128 can be arranged in an upper portion of the storage container 120 above a second set, array, or tier of cleaning pads 134 located in a lower portion of the storage container 120. It is also contemplated that the first set, array, or tier of cleaning pads 128 can be arranged in an upper portion of the storage container 120 at least partially above the second set, array, or tier of cleaning pads 134.

In one example, the first set of cleaning pads 128 can have a first cleaning efficacy, and the second set of cleaning pads 134 can have a second cleaning efficacy that is different than the first set of cleaning pads 128 to provide the user with different levels of cleaning efficacy depending on the desired level of cleaning. In such an example, the first set of cleaning pads 128 can include a substrate and/or a cleaning composition with a lesser cleaning efficacy than a substrate and/or a cleaning composition of the second set of cleaning pads 134. For example, the first set of cleaning pads 128 can be flushable cleaning pads and disposed of after use in a toilet and can be configured for touch-up or daily cleaning, and the second set of cleaning pads 134 can be disposable cleaning pads configured for heavy or more periodic cleaning situations and in certain instances may not be configured to be flushable. Different levels of cleaning efficacies and including more than two different pad types having different cleaning efficacies are also contemplated.

Alternatively, the storage container 120 can be used to support only one type of cleaning pad. For example, the storage container 120 can be configured to support one or more arrangements of the first set of cleaning pads 128 or one or more arrangements of the second set of cleaning pads 134 separately or in conjunction with additional cleaning materials. Such an example may be optimal for a consumer that needs or prefers to use one type of pad over another or that desires another type of cleaning material in conjunction with a particular type of pad. If only a single arrangement of either the first set of cleaning pads 128 or the second set of cleaning pads 134 is being stowed within the storage container 120, the space that would otherwise be occupied by a second arrangement or set of cleaning pads can be used for storage. For example, either the first set of cleaning pads 128 or the second set of cleaning pads 134 can be supported in the upper portion of the storage container 120 while the remaining portions (e.g., lower portion, etc.) of the storage container 120 can be used for the storage of additional pads, rimblocks, cageless toilet care products, drop-in toilet care products and/or any other article that a user may desire to stow within the storage container 120.

The upper or top portion of the storage container 120 can include, or be configured to receive, a first cleaning pad support structure that is configured to support the first set of cleaning pads 128 in a manner that allows individual cleaning pads from the first set of cleaning pads 128 to be removed by the wand 140 while the remaining cleaning pads of the first set of cleaning pads 128 remain in the storage container 120.

In one example, the first cleaning pad support structure can be a tray 126, which holds the first set of cleaning pads 128 therein. The lid 130 can be placed on the upper portion of the storage container 120 and can be configured to expose the first set or array of cleaning pads 128 when the lid is opened by the user such that the user can grasp the cleaning pads 128 with the head 142 of the wand 140. The lid 130 can also be configured to pivot on the hinge 124. However, it is also contemplated that the lid 130 can connect to the top of the container using other known connections such as friction/interference-type fit or a threaded connection in which case the lid 130 can be, for example, slid, rotated, or pulled off of the container. The tray 126 can be held or received in the top portion or upper portion of the storage container 120 just under a rim 154 of the storage container 120 such that the tray 126 does not interfere with the closing of the lid 130. Alternatively, the tray 126 can be held into place on the rim 154 of the storage container 120 such that the tray 126 can be held in an upper portion of the storage container 120, and the lid 130 can be configured to accommodate the tray 126 when the lid 130 is in the closed position. The tray 126 can hold the first array of cleaning pads 128 in such a manner that, when the lid 130 is in the open first position, a user can secure a cleaning pad 128 from the first array of cleaning pads 128 onto a cleaning implement without the user directly touching the cleaning pad 128. The tray 126 can be removable such that the user can selectively remove the tray 126 from the storage receptacle 120 for replenishing the tray 126 when depleted of cleaning pads 128, replacing the tray 126 when depleted of cleaning pads and accessing the at least one additional cleaning material, such as the second set of cleaning pads 134.

Additionally, as shown in FIGS. 1B and 1C, the lower or bottom portion of the storage container 120 can include, or be configured to receive, a second cleaning pad support structure that is configured to support the second set of cleaning pads 134 in a manner that allows individual cleaning pads from the second set of cleaning pads 134 to be removed by the wand 140 while the remaining cleaning pads of the second set of cleaning pads 134 remain in the storage container 120. In one example, the second cleaning pad support structure can be a sleeve 132, which can contain a second set of cleaning pads 134. The cleaning pads 134 can be arranged vertically within the sleeve 132, and the second set or tier of cleaning pads 134 can be offset from each other in a vertical direction within the sleeve 132.

With the arrangement shown in FIGS. 1B and 1C, to access the first set of cleaning pads 128, the user can simply open the lid 130 of the storage container 120 and grasp one of the first set of cleaning pads 128 with the wand 140. Furthermore, to access the second set of cleaning pads 134, the user can remove the tray 126, and the first set of cleaning pads 128, to expose the second set of cleaning pads 134 in the sleeve 132 located in the bottom of the storage container 120 and then grasp one of the second set of cleaning pads 134 with the head 142 of the wand 140. Therefore, the user will not have to directly touch or handle either the first set of cleaning pads 128 or the second set of cleaning pads 134 in order to transfer an individual cleaning pad from the storage container 120 to the head 142 of the wand 140.

As shown in FIGS. 1B and 1C, the gripping orientation of the first set of cleaning pads 128 can be arranged perpendicular to the gripping orientation of the second set of cleaning pads 134. This allows for the storage container 120 to be formed narrower such that it takes up less space in the consumer's bathroom. However, as discussed below in relation to FIGS. 7A-7D arranging the first set of cleaning pads 128 parallel to the second set of cleaning pads 134 is also contemplated and may be desired in certain instances.

Figure 1F:
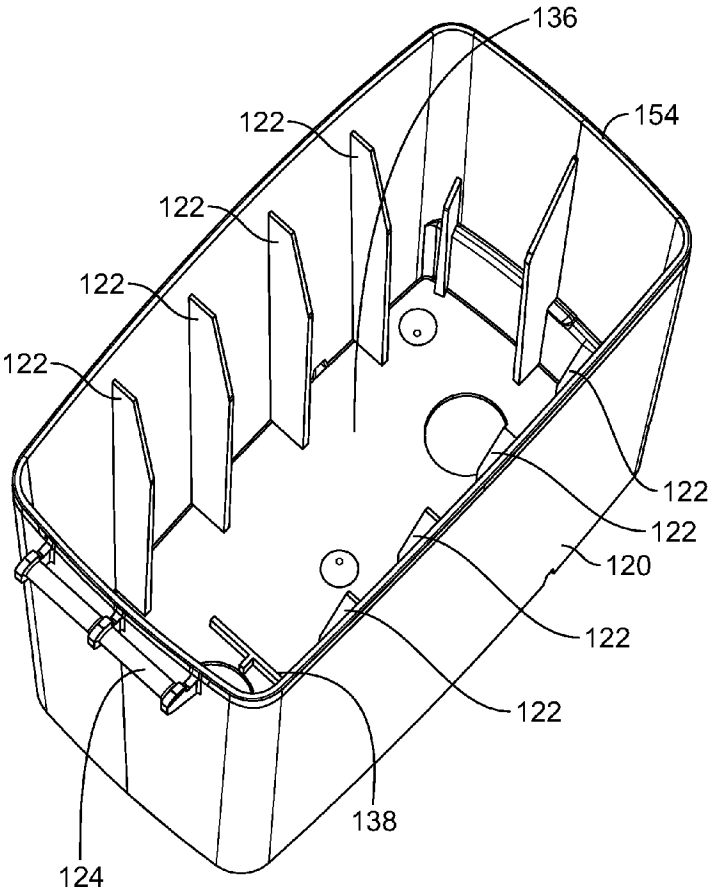
FIGS. 1E and 1F show top perspective views of the example storage caddy of FIG. 1A with a lid, sleeve, and tray removed.
Figure 1E:
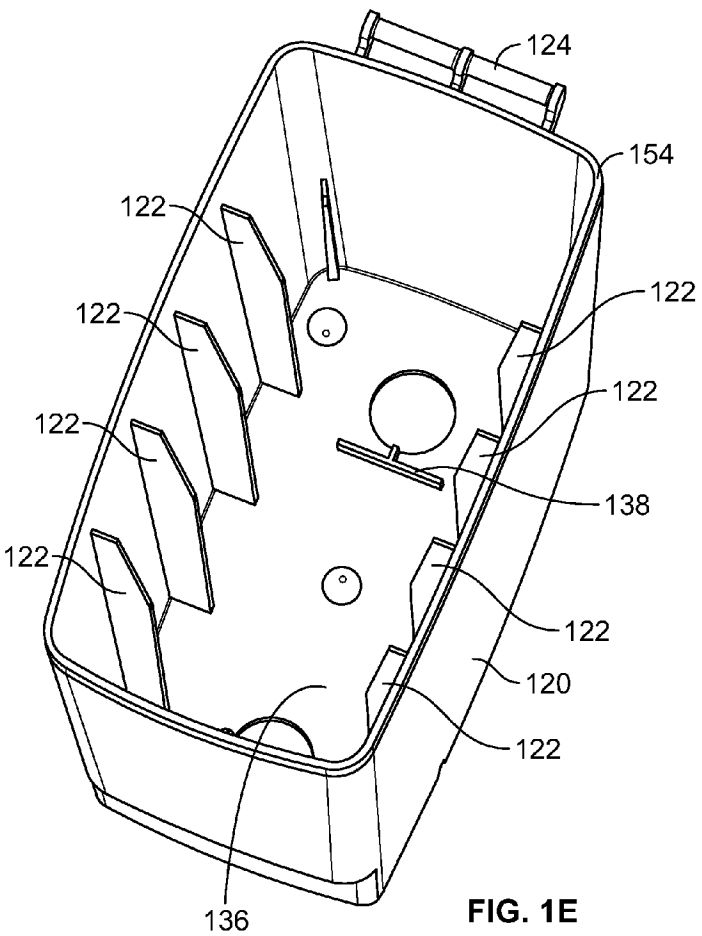
Figure 1G:
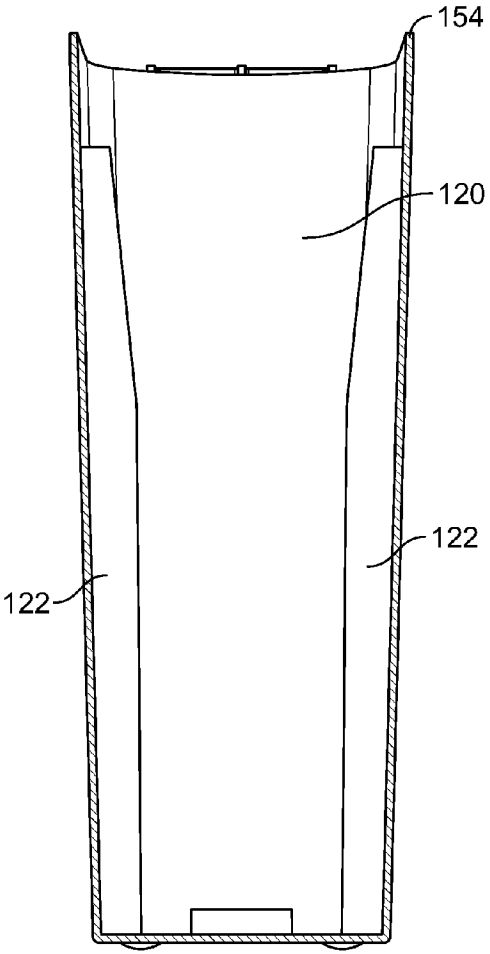
FIG. 1G is a cross-sectional view of FIG. 1E with a lid, sleeve, and tray removed.

FIG. 1D shows a top perspective view of the container 120 with the lid 130 and tray 126 removed. FIGS. 1E and 1F show a top perspective view of the storage container 120 with the lid 130, sleeve 132, and tray 126 removed. FIG. 1G shows a cross-sectional view of FIG. 1E. As shown in FIGS. 1D-1G, the inside of the storage container 120 can be provided with a plurality of tapered vertical ribs or projections 122. The plurality of projections 122 extend around an inside perimeter of the storage container 120 and provide support for the tray 126 and sleeve 132.

As described in more detail below, the tapered vertical ribs or projections 122 can together form a top surface to support and receive the tray 126 in the top portion of the storage container 120. The plurality of tapered vertical ribs or projections 122 can form or define a plane, and a rim 150 of the tray 126 can be configured to sit on the plane formed by the plurality of projections 122. As shown in FIG. 1B, the tapering of the ribs 122 accommodates the tray 126 in the upper portion of the storage container 120 above the sleeve 132. Specifically, the tapered portions of the ribs provide an area for the tray 126 to extend into the storage container 120.

The tapered vertical ribs or projections 122 can be formed wider at the base of the storage container 120 to secure the sleeve 132 therein by a press-fit type or interference-fit type of connection. To accomplish the press-fit connection between the sleeve 132 and the storage container 120, the tapered vertical ribs 122 can be provided with certain predetermined spacing so that the sleeve 132 is slightly larger than the opening defined by the tapered vertical ribs 122. In one example, the plurality of ribs 122 can form a first set of parallel planes and the sleeve 132 can form a second set of parallel planes, and the distance between the first set of parallel planes can be less than a distance between the second set of parallel planes to secure the sleeve in the storage container 120. Because the spacing between the narrow walls of the projections is less than the size of the sleeve 132, the projections interfere with the removal of the sleeve 132. In this way, the user can remove a single pad of the second set of cleaning pads 134 with the wand 140 without inadvertently removing the sleeve 132 and/or the remaining pads 134 from the storage container 120.

As shown in FIGS. 1E and 1F, the inside bottom surface or floor 136 of the storage container 120 can also include a floor projection 138, which also maintains the sleeve 132 in position in the bottom portion of the storage container 120. The floor projection 138 is configured to engage a face of the sleeve 132 to assist in locating the sleeve 132 in place on the floor of the storage container 120. The floor projection 138 can prevent the sleeve 132 from moving along the inside bottom surface or floor 136 of the storage container 120.

In alternative example, instead of using ribs or projections 122, the tray 126 can be held in the top of the storage container 120 by a shelf or ridge that extends around the inside perimeter of the storage container 120. The ridge can support a rim of the tray in the top portion of the storage container 120. Likewise a lower ridge could be placed toward the bottom of the storage container 120 and could also provide an interference fit between the sleeve 132 and the storage container 120 to hold the sleeve 132 in place in the bottom of the storage container 120. A person of ordinary skill in the art would understand that various connections are known in the art for securing the tray 126 or sleeve 132 in the storage container, including, for example, friction/interference, barb, adhesive, ball and socket, bayonet, screw thread, etc.

Figure 2A:
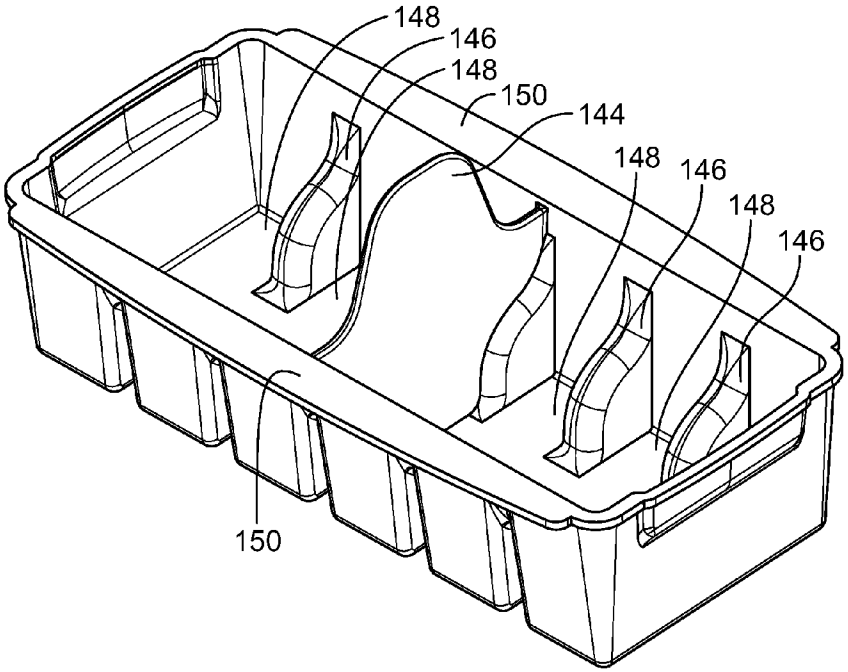
FIG. 2A shows a top left perspective view of an exemplary tray according to one aspect.
Figure 2B:
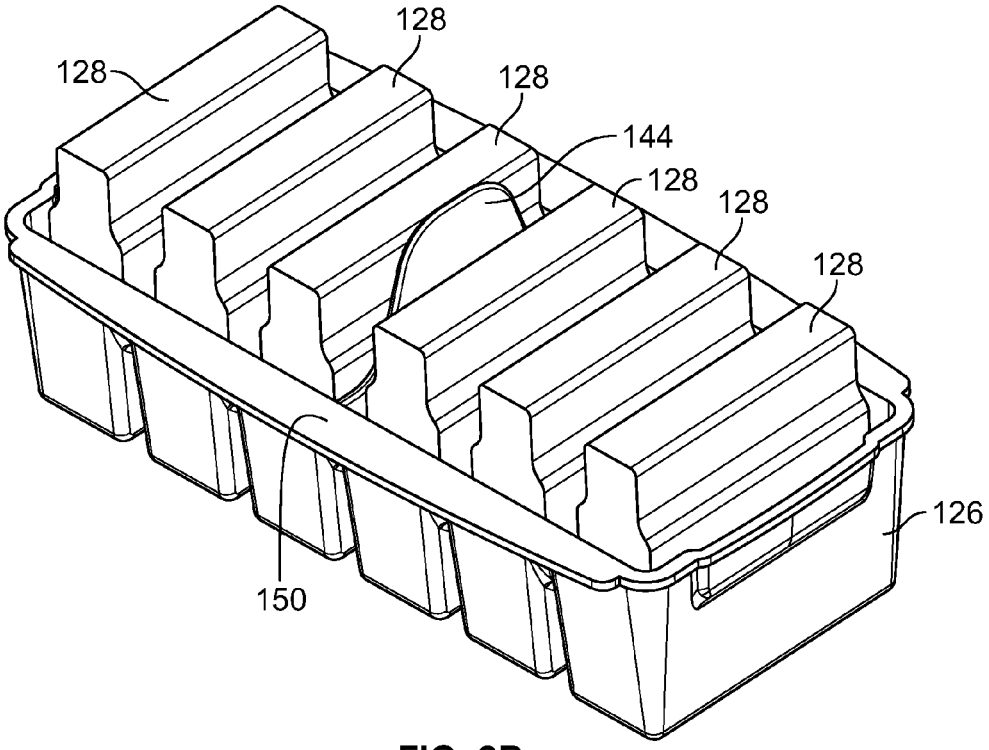
FIG. 2B shows another top left perspective view of the exemplary tray of FIG. 2A with cleaning pads loaded therein.
Figure 2C:
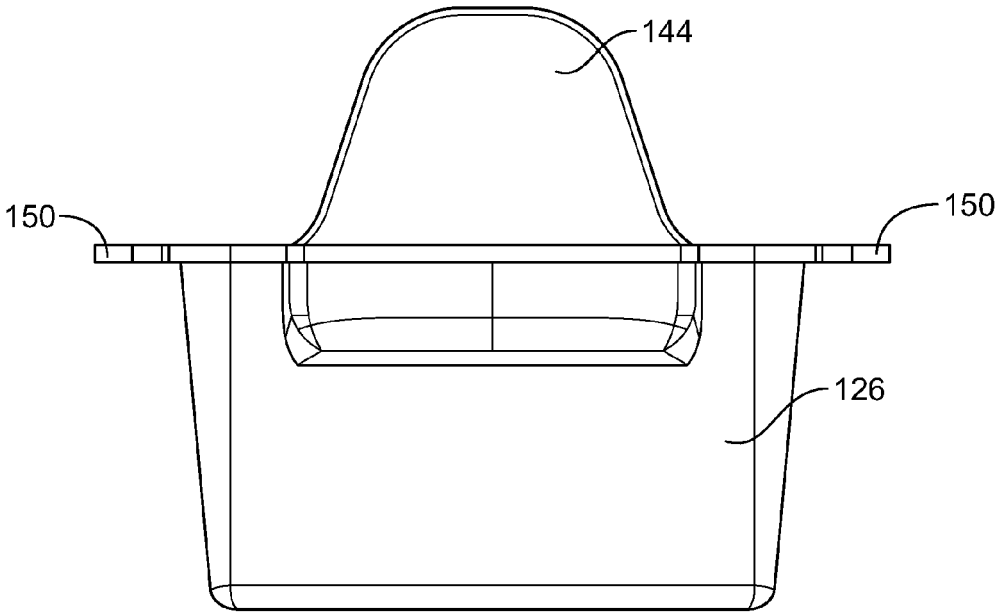
FIG. 2C shows a front view of the exemplary tray of FIG. 2A.
Figure 2D:
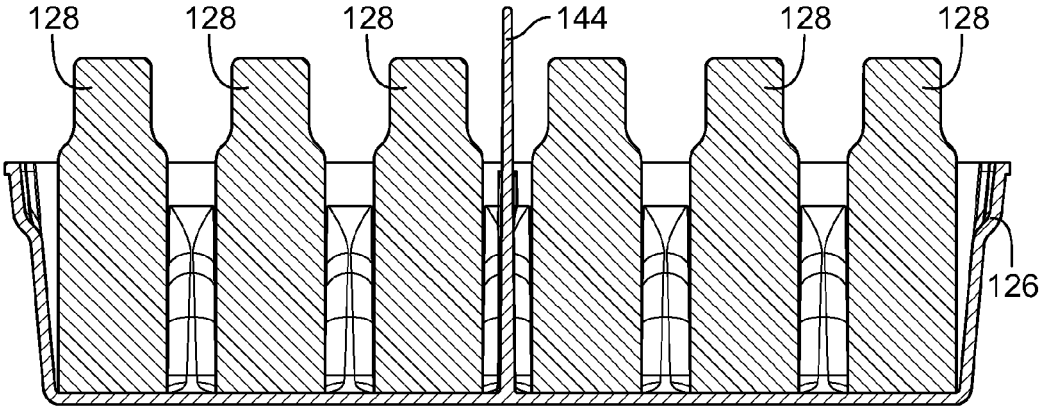
FIG. 2D shows a cross-sectional view the exemplary tray of FIG. 2B.

FIGS. 2A-2D show an exemplary tray 126. FIGS. 2A and 2C show the exemplary tray 126 without the first set of cleaning pads 128, and FIGS. 2B and 2D show the exemplary tray 126 with the first set of cleaning pads 128 disposed therein. In this example, the tray 126 can be provided with six cleaning pads 128, however the tray 126 can be configured to accommodate other numbers of pads. In this example, the tray 126 can be outfitted with a handle 144 for grasping by the user such that the user can place the tray 126 in the top of the storage container 120 and also remove the tray 126 from the top of the storage container 120. The tray 126 can be configured to space apart each cleaning pad 128 of the first array of cleaning pads 128 in a substantially horizontal direction and therefore can be horizontally offset from each other in a horizontal direction within the tray 126.

By providing the user with the ability to selectively remove the tray 126 from the storage container 120 in its entirety, refilling of the tray 126 with pads 128, if desired, may be simplified by enabling the user to conduct the refilling at position more convenient than the typical location of the storage container 120 (e.g., the floor, etc.), such as on a counter or tabletop. In one example, the handle 144 is centrally located on the tray 126 and has gripping orientation that is parallel to the wand gripping orientation of the cleaning pads 128 supported within the tray 126. Alternatively, the handle 144 may be located at any of a number or locations relative to the tray 126 and at any of a number of orientations. The handle 144 or the tray 126 itself can also be provided with protuberances or other types of gripping elements to facilitate the user's ability to grasp the tray.

Ribs 146 can be placed into the tray 126 so as to form compartments 148 for receiving the first set of cleaning pads 128. The compartments 148 can be closely positioned next to adjacent compartments or may be spaced apart from adjacent compartments a distance sufficient to allow clearance for the head 142 of the wand 140 as the wand 140 is used to grip and remove one of the cleaning pads 128 from the tray. The tray 126 can be formed out of a PET material or other suitable material and can be formed in a vacuum forming process or any other type of molding process.

The tray 126 can be arranged as a sealed blister pack with a cover, which can be formed of a foil material. The tray 126 can also be formed together with an identical second row of slots for receiving additional cleaning pads, which in one example can provide six additional slots for receiving additional cleaning pads. Also, it is contemplated that the design of the tray 126 can be simplified by removing the handle 144.

The tray 126 can also be formed with a rim 150 that extends around the periphery or perimeter of the tray 126. The rim 150 can provide a lower surface that can be placed into contact with the tapered vertical ribs 122 or other structure to support the tray in the top portion of the storage container 120. In this example, therefore, the rim 150 acts as a support for the tray 126 in the upper portion of the storage container 120. Specifically, the peripheral rim 150 can be configured to engage the container 120 for supporting the tray 126 in the upper portion of the storage receptacle 120.

Figure 3:
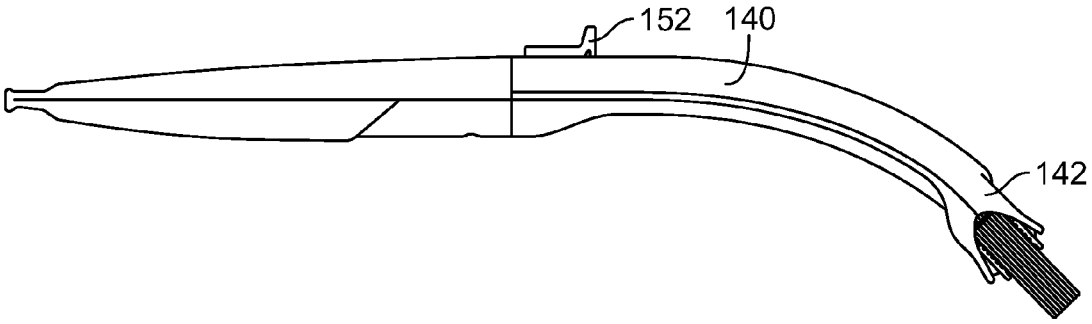
FIG. 3 shows a perspective view of an exemplary wand.

FIG. 3 illustrates an exemplary wand 140 that may be used with one or more of the embodiments discussed herein. The wand 140 is configured to receive one of the first set of cleaning pads 128 or one of the second set of cleaning pads 134. In one example, the head 142 of the wand 140 may be provided with jaws having grab teeth for gripping the cleaning pads during the use of the pads for cleaning. The wand 140 may also be provided with an internal actuator and a button in the form of a projection 152 for moving the actuator along the wand to cause the jaws and teeth to grip the cleaning pads. A wand of this type is disclosed and described in U.S. Pat. Nos. 7,059,008, 7,159,256, 7,316,046, 7,581,276, 7,650,663, and 7,827,648, all of which are incorporated fully herein by reference.

In use, the user can remove the wand 140 from the slot 112 of the holder 110 by grasping the handle of the wand 140 and sliding the wand 140 out of the slot 112. The user can then open the lid 130 of the storage container 120 and select between using the first set of cleaning pads 128 and the second set of cleaning pads 134 depending on the degree of cleaning required and/or the preferences of the user. If use of the first set of cleaning pads 128 is desired, the user can simply remove one of the first set of cleaning pads 128 with the wand 140. In particular, the user can place the jaws on one of the first set of cleaning pads 128 located in the tray and slide the button 152 to grasp one of the first set of cleaning pads 128. The cleaning pad 128 can then be immersed into a toilet to clean the bowl and under the rim of the toilet. The button 152 can then be slid in the opposite direction to release the cleaning pad 128, and the pad can then be disposed directly in the toilet and flushed or disposed of in the trash. The user can then return the wand 140 to the slot 112 of the holder 110 for storage of the wand 140 after use.

If use of the second set of cleaning pads 134 is desired, the user can selectively move, remove or reconfigure the tray 126 to expose the second set of cleaning pads 134. In one example, the user can remove the tray 126 from the storage container 120 in its entirety (e.g., by grasping the handle 144 and lifting the tray 126 in an upward direction, etc.) to expose the second set of cleaning pads 134. Once exposed, the second set of cleaning pads 134 can be used in a similar manner as the first set of cleaning pads 128, with the exception that, in certain embodiments, the second set of cleaning pads 134 may not be intended to be flushed down the toilet after use. When it is desired or needed, the user can also replace the first set and the second set of cleaning pads 128, 134 in the storage container 120 as discussed herein.

With such an arrangement, once the cleaning pads 128 are stowed within the storage container 120, the user will not have to directly touch or otherwise handle the cleaning pads in order to secure a cleaning pad to the wand 140. Further, by placing the more commonly used cleaning pads (e.g., the first set of cleaning pads 128, etc.) on top of the other cleaning pads (e.g., the second set of cleaning pads 134, etc.), the number of times that the user will need to manipulate the storage caddy 100 (e.g., move, remove or otherwise reconfigure the tray 126, etc.) in order to access the desired type cleaning pad can be reduced.

Figure 4B:
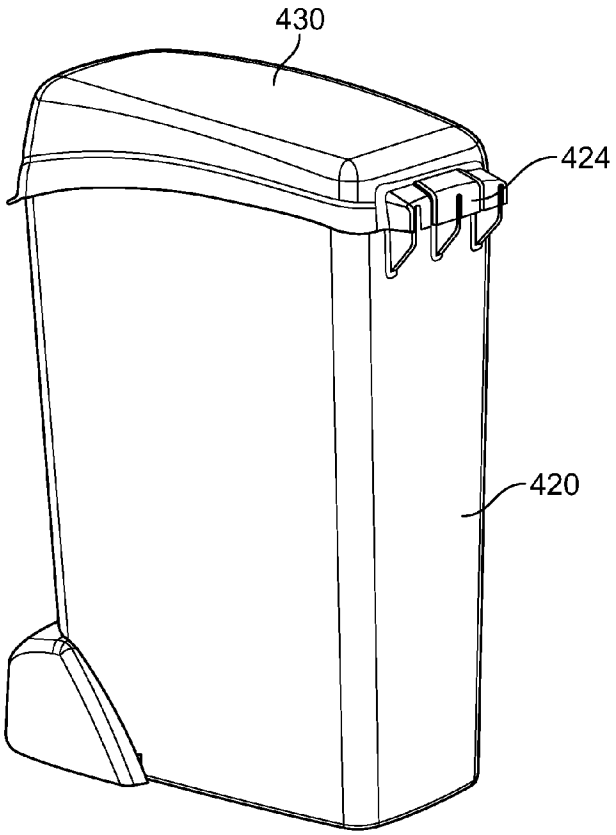
FIG. 4B shows a rear perspective view of the example storage caddy of FIG. 4A.
Figure 4A:
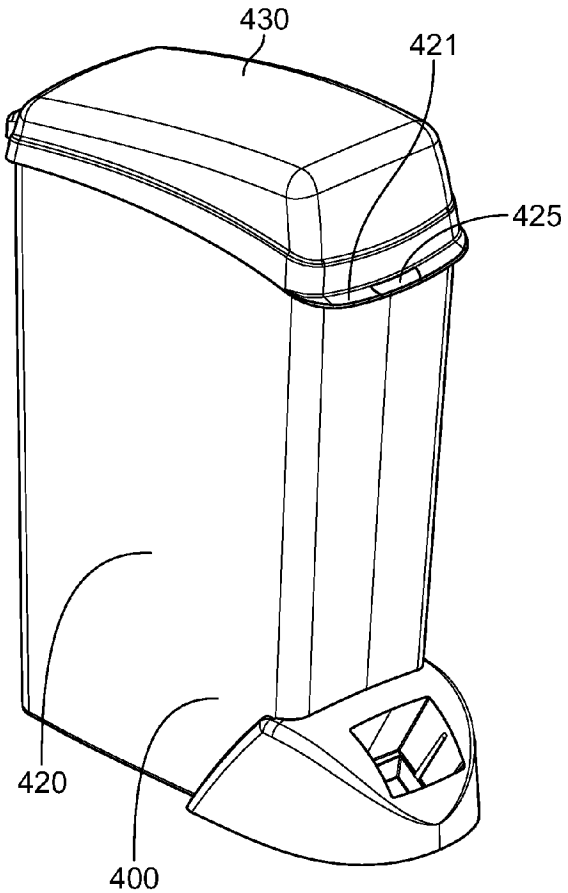
FIG. 4A shows a front perspective view of another example storage caddy.
Figure 4C:
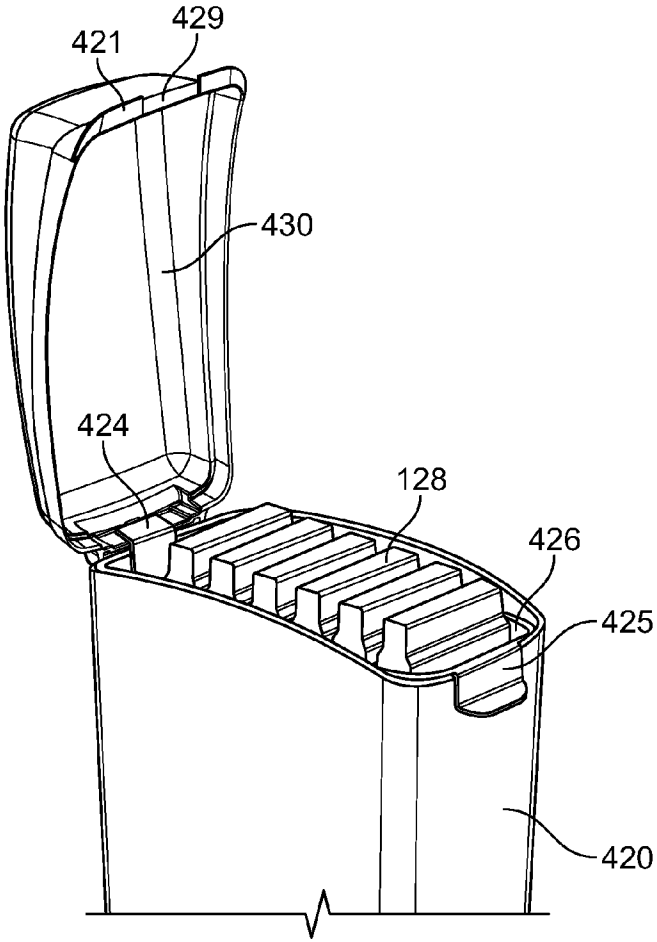
FIG. 4C shows a front perspective the example storage caddy of FIG. 4A in an opened position.

FIGS. 4A-4C depict another example of a toilet caddy 400, which is similar to the example toilet caddy described in relation to FIGS. 1A-1G, where similar reference numbers are used to identify similar components. However, in this example, the lid 430 and the tray 426 are configured to pivot on a shared pivot point or hinge 424 on the storage container 420. This permits the user to open the lid 430 and to rotate the tray 426 to expose the sleeve containing the second set of pads. The tray 426 can be provided with a tray tab 425 that extends under the tab 421 of the lid 430 through a slot 429 in the lid 430. The user can open just the lid 430 by lifting the tab 421 to load the wand 140 with the first set of cleaning pads 128 and can open both the lid 430 and the tray 426 by lifting the tray tab 425 to load the wand 140 with the second set of cleaning pads (not shown) under the tray 426.

Figure 5A:
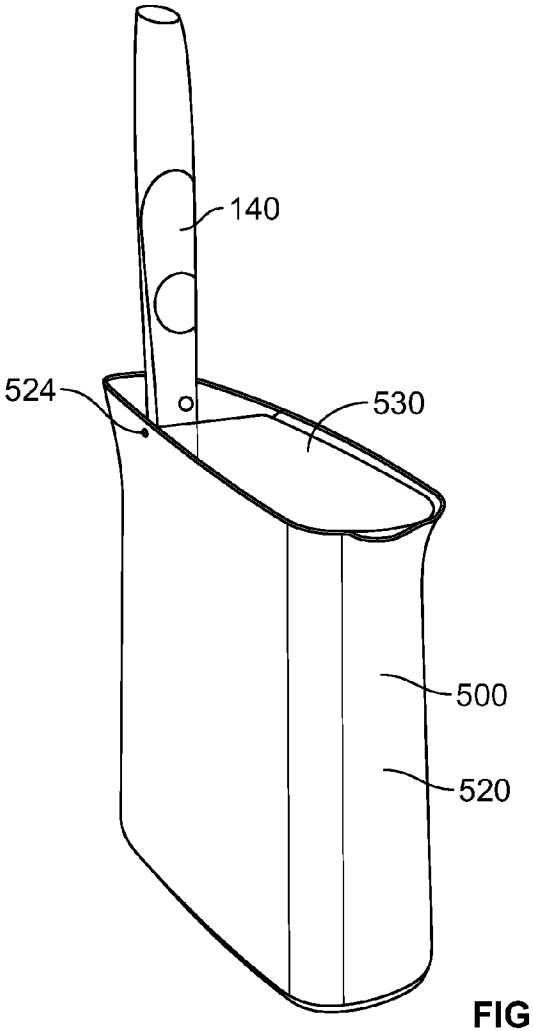
FIG. 5A shows a front perspective view of another example toilet caddy.
Figure 5C:
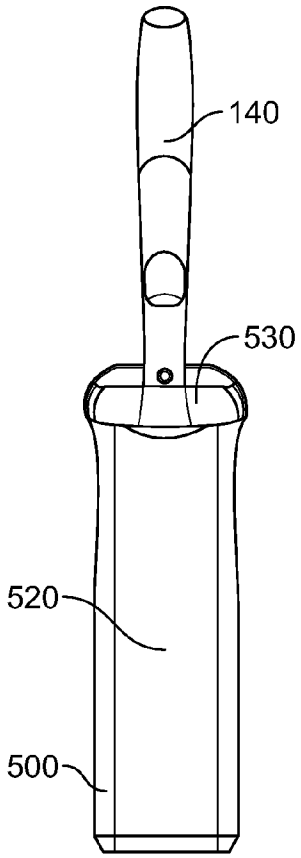
FIG. 5C shows a front view of the toilet caddy of FIG. 5A.
Figure 5B:
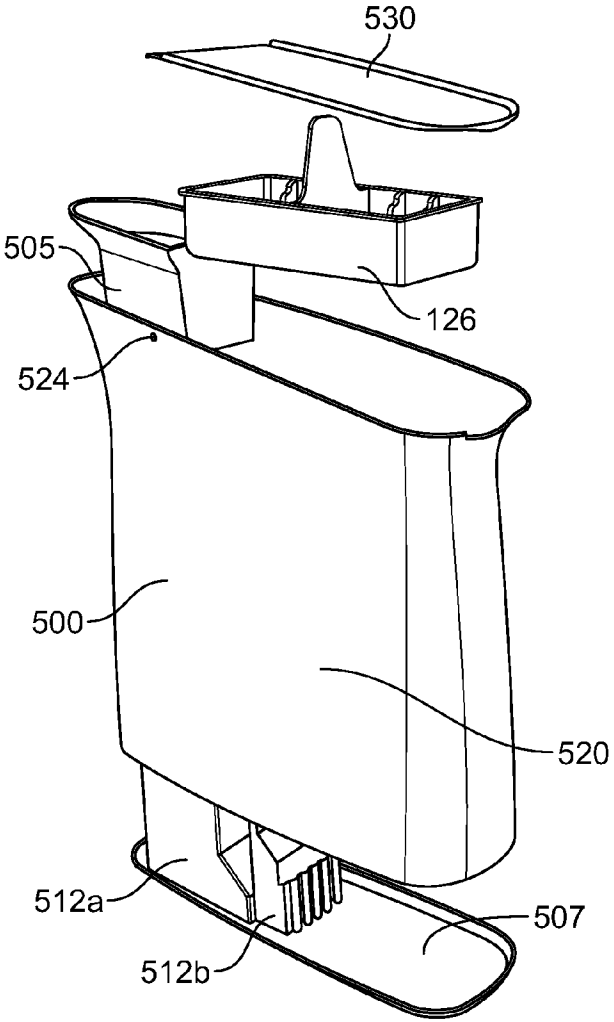
FIG. 5B shows an exploded view of the toilet caddy of FIG. 5A.
Figure 5E:
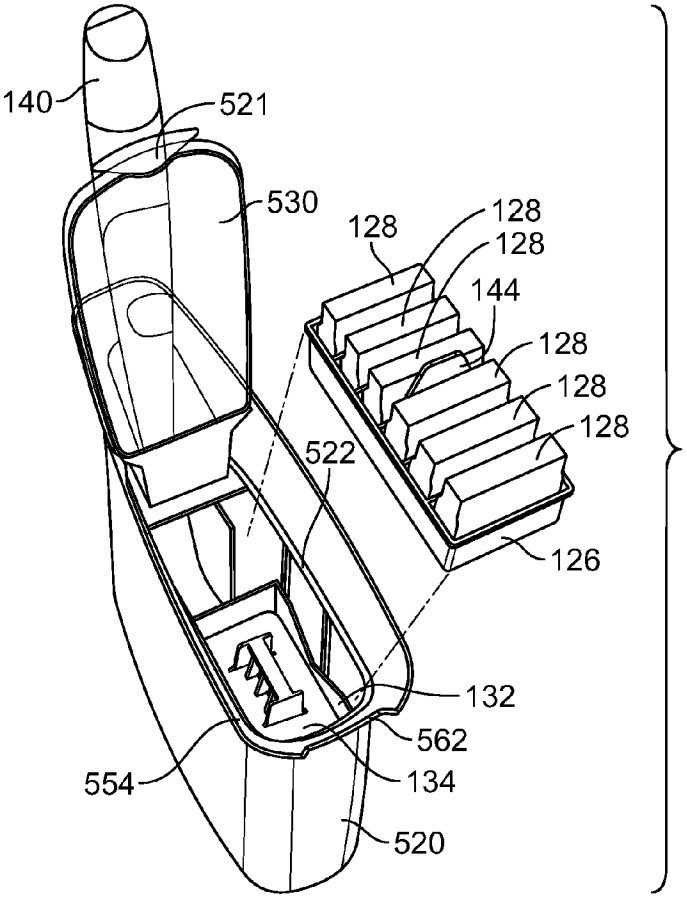
FIG. 5E shows a perspective exploded view of the toilet caddy of FIG. 5A with the tray removed.
Figure 5D:
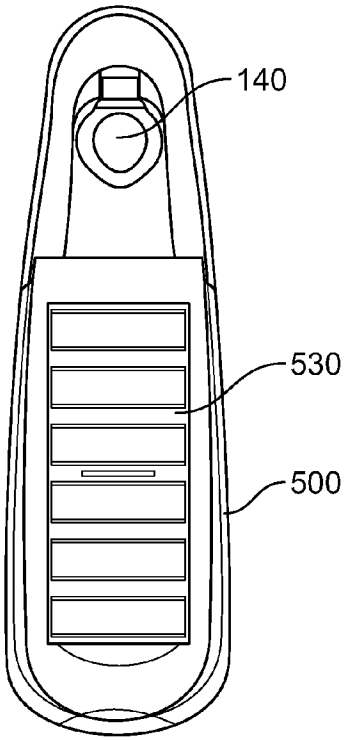
FIG. 5D shows a top view of the toilet of FIG. 5A.
Figure 5F:
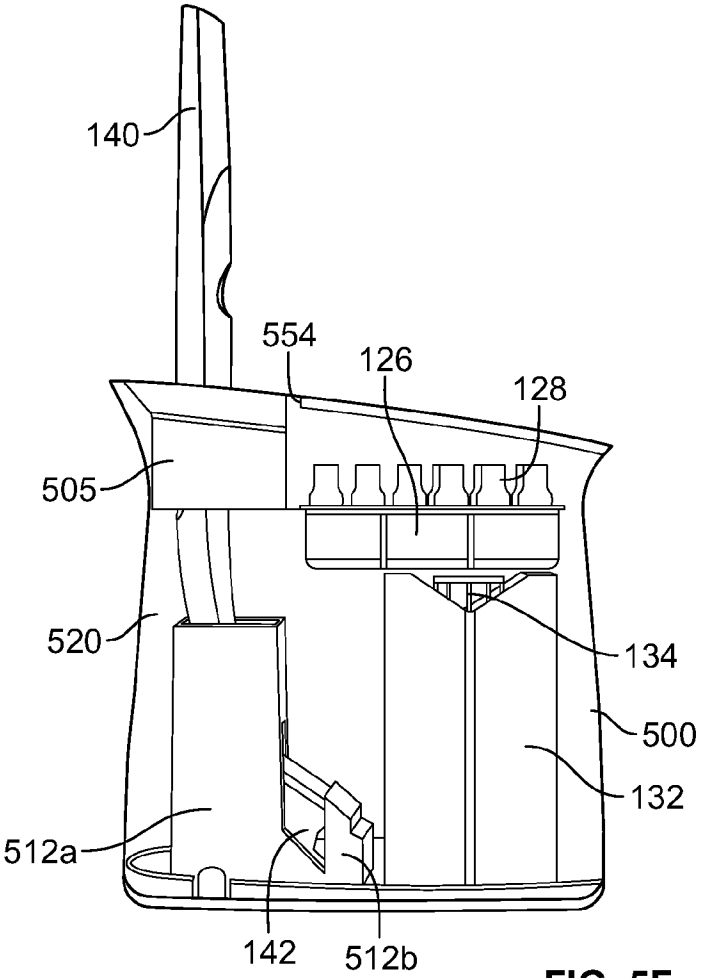
FIG. 5F shows a transparent view of the toilet caddy of FIG. 5A.

FIGS. 5A-5F depict another example of a toilet caddy 500 that can be used to store a cleaning implement and cleaning supplies. FIG. 5A shows a front perspective view of the toilet caddy 500, and FIG. 5B shows an exploded view of the toilet caddy 500. FIG. 5C shows a front view of the toilet caddy 500, and FIG. 5D shows a top view of the toilet caddy 500. FIG. 5E shows a perspective exploded view of the toilet caddy 500 with the tray 126 removed from the top of the toilet caddy 500. FIG. 5F shows a transparent view of the toilet caddy 500 to illustrate the internal components therein.

In this example toilet caddy 500, the head 142 of the wand 140 and a portion of the body or shaft of the wand 140 can be stored inside the storage container 520. The toilet caddy 500 generally includes a lid 530, a tray 526, a top insert 505, and a floor insert 507 for receiving the wand 140 and a storage container 520 for housing cleaning supplies, e.g., toilet gels, refills, cleaning pads, etc. The lid 530 can rotate on the storage container 520 by a hinge 524 or other suitable connection as described herein such that during use, the user can open the lid 530 and access the cleaning pads with the wand 140. As shown in FIG. 5D, the lid 530 can be formed transparent such that the user can see the cleaning pads in the top of the storage container 520.

Unlike the example shown in relation to FIGS. 1A-1G, the head 142 of the wand 140 is held in the storage container 520 in the example shown in FIGS. 5A-5F. To accommodate such a storage configuration, the top insert 505 defines an opening configured to receive the wand 140. The size and/or the inner contours of the insert 505 can be configured to assist a user in locating the storage area for the wand 140 and aligning the wand 140 with its holder. In the example shown, the opening in the top insert 505 is defined by an inner wall that tapers in a downward direction. The larger opening on top allows a user to easily locate the storage area for the wand 140, while the narrowing taper of the inner wall allows the wand 140 to be guided into its proper storage position without further assistance by the user. Thus, a user can properly store the wand 140 by dumping or dropping the wand 140 into the opening defined by the top insert 505 rather than having to align the head 142 with a holder.

In the example shown, the wand 140 achieves its proper storage position when the head 142 of the wand 140 is received within the floor insert 507. The floor insert 507 can be provided on the bottom of the storage container 520 and can include a column 512*a* and slot 512*b* for receiving the wand 140 as shown in FIG. 5F. The column 512*a* and slot 512*b* can be configured to hold the wand 140 in place in the storage container 520. Additionally the top insert 505 helps to maintain the wand in a proper position in the storage container 520 without interfering with the tray 126.

As shown in FIG. 5E, the top of the storage container 520 can be provided with molded ribs 522. The molded ribs 522 provide a support for the tray 126 in the top or upper portion of the storage container 520 such that the tray 126 can be positioned above the sleeve 132. The rim 554 of the storage container 520 can be tapered outwardly to accommodate for the tray 126. The rim 554 can also be provided with an opening or cutout portion 562 to receive a tab 521 located on the lid 530. The tab 521 located on the lid 530 provides the user with a grasping portion for opening the lid 530 of the storage container 520 and in one example can also provide a friction-type lock between the lid 530 and the storage container 520.

Similar to the example described in relation to FIGS. 1A-1G, as shown in FIG. 5F the first set of cleaning pads 128 can be arranged in an upper portion of the storage container 520 above the second set of cleaning pads 134 located in a lower portion of the storage container 520. The first set of cleaning pads 128 and the second set of cleaning pads 134 can also be oriented perpendicular to each other in the storage container, which again may provide for a more narrow width of the storage container to take up less space in the consumer's bathroom.

The lid 530 can also be placed on the upper portion of the storage container 520 and is configured to expose the first set of cleaning pads 128. Furthermore, like the example described in relation to FIGS. 1A-1G, to access the second set of cleaning pads 134, the user can remove the tray 126 by grasping the handle 144 of the tray to remove the tray 126 and expose the cleaning pads 134 in the bottom of the storage container 520. The user can then grasp one of the second set of cleaning pads 134 with the wand 140.

Figure 6A:
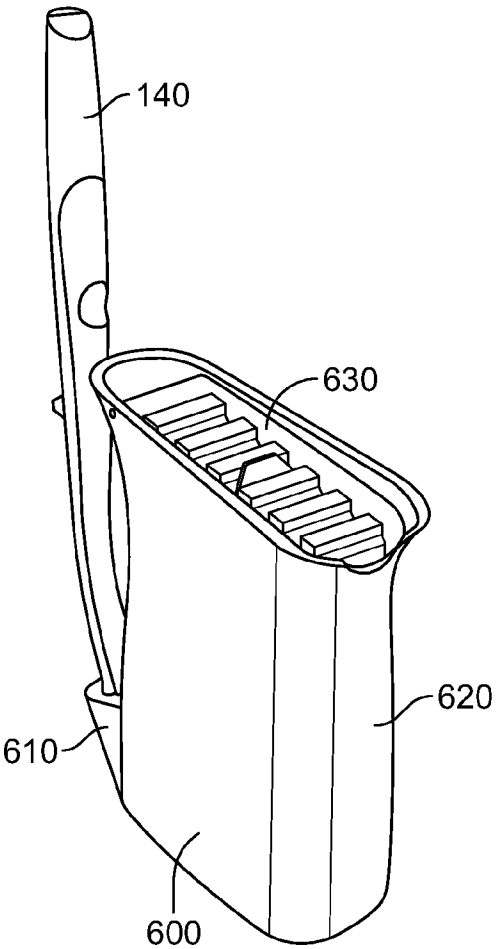
FIG. 6A shows a front perspective view of another example toilet caddy.
Figure 6C:
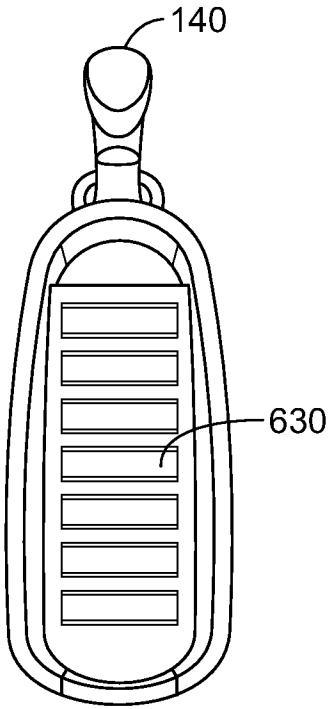
FIG. 6C shows a top view of the toilet caddy of FIG. 6A.
Figure 6B:
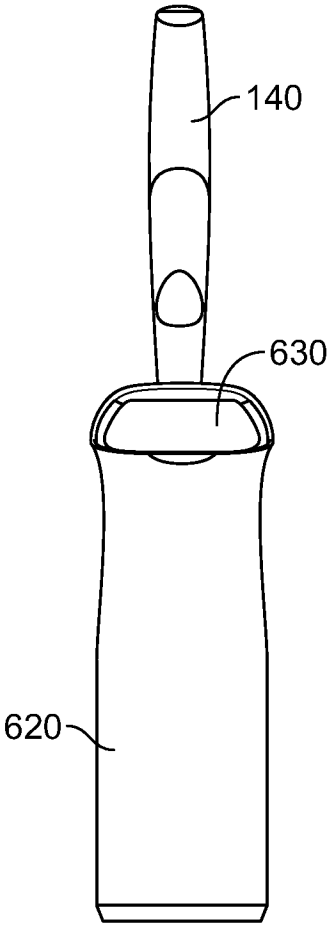
FIG. 6B shows a front view of the toilet caddy of FIG. 6A.
Figure 6D:
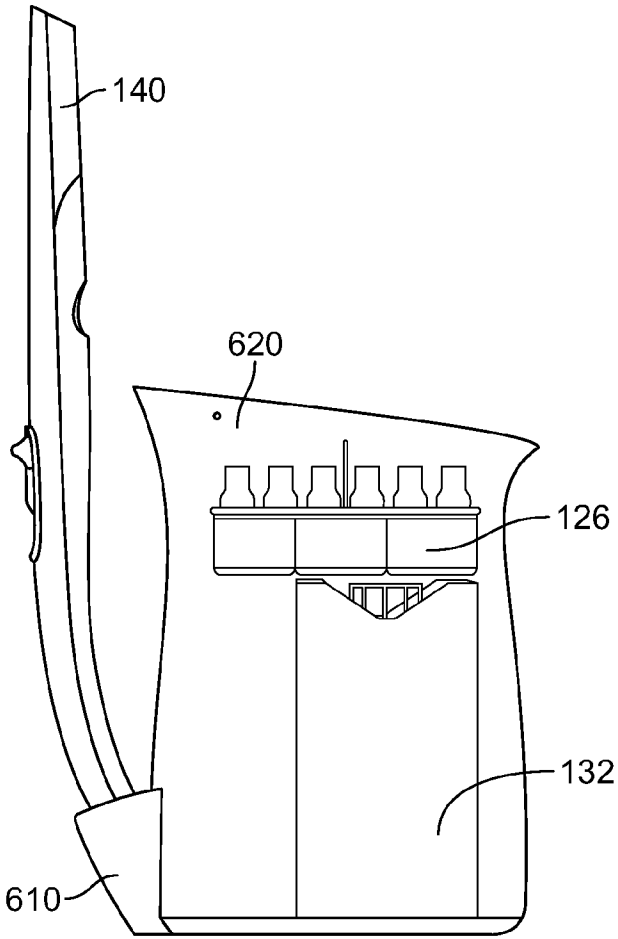
FIG. 6D shows a side transparent view of the toilet caddy of FIG. 6A.

FIGS. 6A-6D show another example of a toilet caddy 600 that can be used to store a cleaning implement and cleaning supplies. FIG. 6A shows a front perspective view of the toilet caddy 600, and FIG. 6B shows a front view of the toilet caddy 600. FIG. 6C shows a top view of the toilet caddy 600, and FIG. 6D shows a side transparent view of the toilet caddy 600 to illustrate the internal components therein.

The toilet caddy 600 is similar to the toilet caddy described in relation to FIGS. 5A-5F in which like reference numerals refer to the same or similar elements in the various views in which that reference number appears. However, in this example, the wand 140 can be stored outside of the storage container 620. In particular, the storage container 620 can be provided with an external base 610 that has a corresponding slot for receiving the wand 140 head 142 Storing the wand 140 outside of the storage container 620, rather than inside, can allow for a reduction in size of the storage container 620. In this case, less material may be needed to manufacture the storage container 620. In addition storing the wand 140 outside of the storage container 620 can permit the wand 140 to dry out after use more quickly.

Figure 7A:
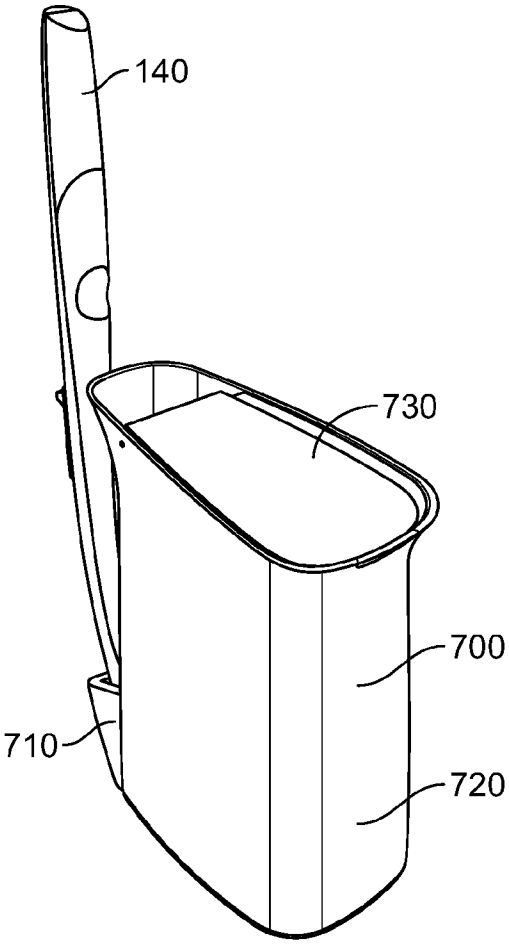
FIG. 7A shows a front perspective view of another example caddy.
Figure 7C:
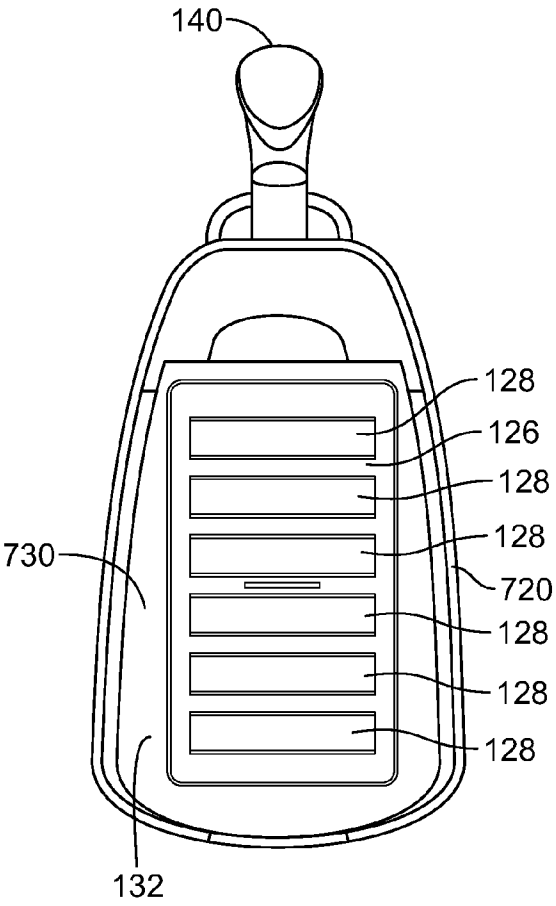
FIG. 7C shows a top view of the example caddy of FIG. 7A.
Figure 7B:
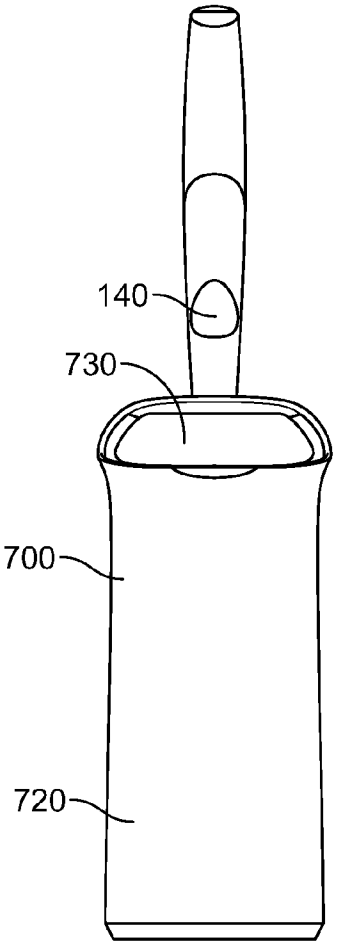
FIG. 7B shows a front view of the example caddy of FIG. 7A.
Figure 7D:
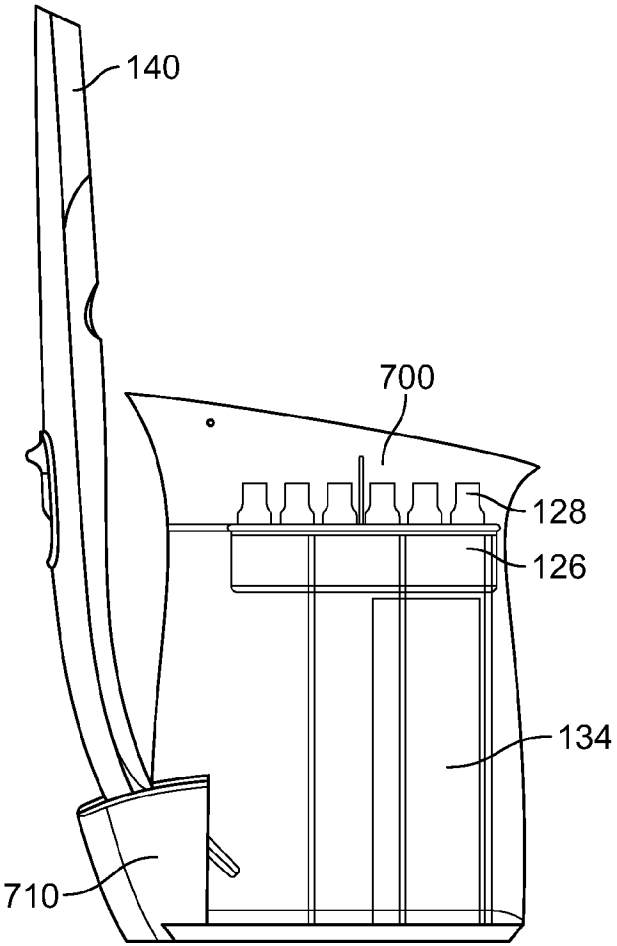
FIG. 7D shows a side transparent view of the example caddy of FIG. 7A.

FIGS. 7A-7D show another example of a toilet caddy that can be used to store a cleaning implement and cleaning supplies. FIG. 7A shows a front perspective view of the toilet caddy 700, and FIG. 7B shows a front view of the toilet caddy 700. FIG. 7C shows a top view of the toilet caddy 700, and FIG. 7D shows a side transparent view of the toilet caddy 700 to illustrate the internal components therein.

The toilet caddy 700 is similar to the toilet caddy described in relation to FIGS. 6A-6D in which like reference numerals refer to the same or similar elements in the various views in which that reference number appears. However, in this example, the storage container 720 can be formed wider such that the second set of cleaning pads 134 in the sleeve 132 can be oriented parallel to the first set of cleaning pads 128 in the tray 126.

As shown in FIGS. 7C and 7D, the cleaning pads 128 can be arranged parallel to the cleaning pads 128. With this arrangement, the user can position the wand 140 in the same orientation to grasp either the first set of cleaning pads 128 or the second set of cleaning pads 134 after the tray 126 containing the first set of pads is removed from the storage container 720. This orientation may be beneficial for maintaining the storage container 720 in the same position in the user's bathroom such that the user can grasp either the first set of cleaning pads 128 or the second set of cleaning pads from the same container position.

Figure 8A:
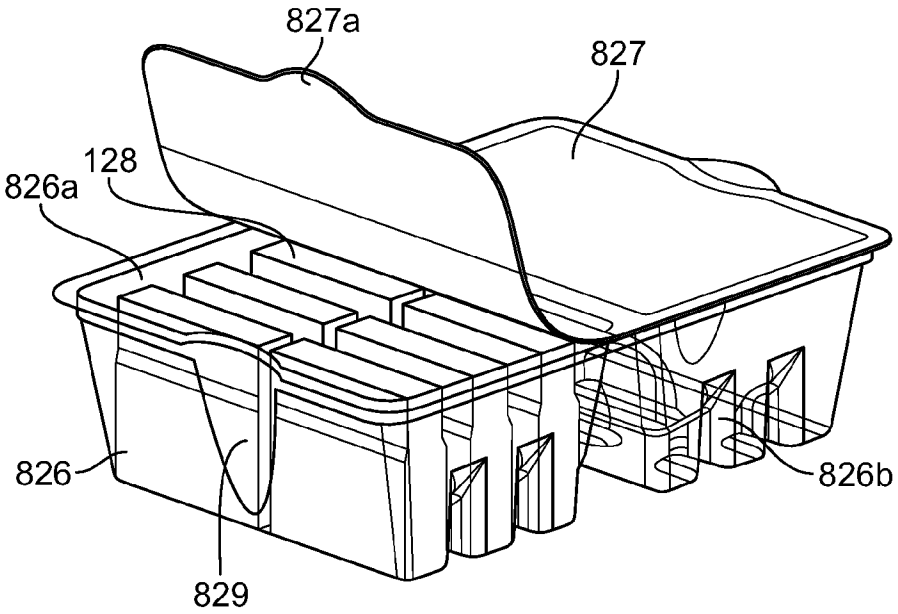
FIG. 8A shows a perspective view of another example tray.
Figure 8B:
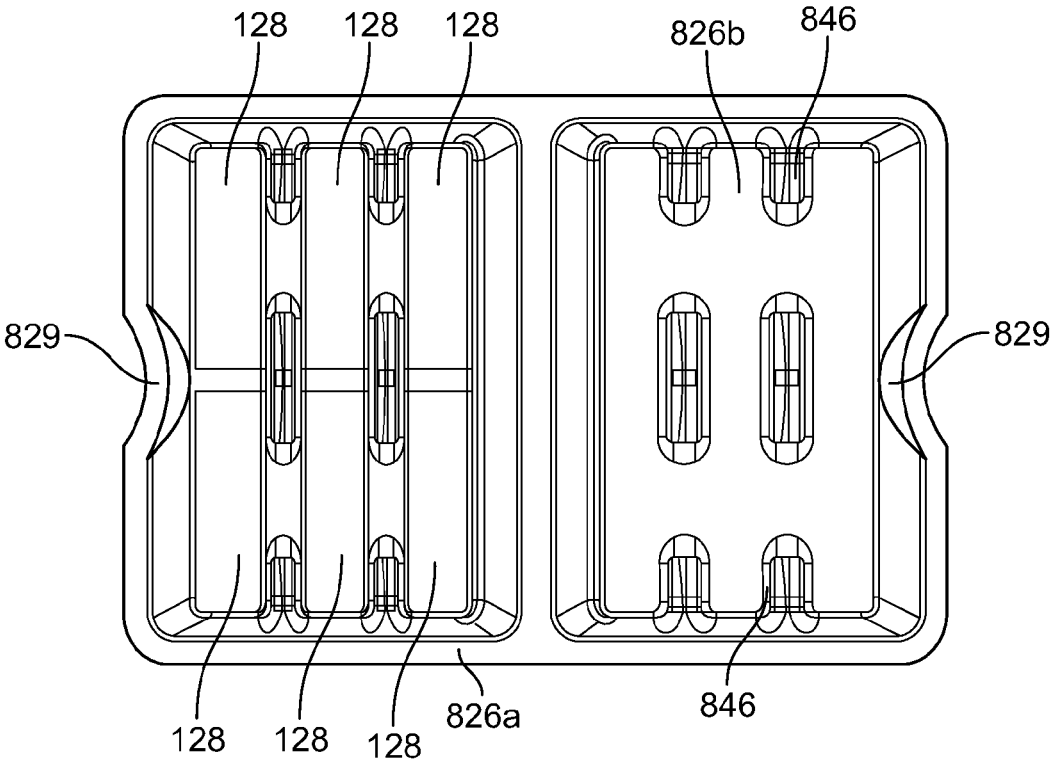
FIG. 8B shows a top view of the example tray of FIG. 8A.

FIGS. 8A and 8B depict an alternative example of a tray 826 that can be used in conjunction with the storage containers disclosed herein. FIG. 8A shows a perspective view of the tray 826, and FIG. 8B shows a top view of the tray 826 partially full of cleaning pads 128. In this example, the tray 826 can be provided with two rows of cleaning pads 128. Such a tray may be particularly suitable if replaceable cleaning pads for the storage caddy 100 are to be sold in combination with the tray and/or as an initial tray included with a storage caddy kit.

The tray 826 can also be provided with two separate sections 826*a*, 826*b* that accommodate six cleaning pads 128 each such that twelve cleaning pads can be placed into the tray 826. The cleaning pads 128 can be aligned along the length of the cleaning pads 128 in rows. Ribs 846 can be arranged in the tray 826 to accommodate the cleaning pads 128 in the tray 826.

Additionally a cover 827, which can be a foil material, can be provided to seal the cleaning pads 128 in the tray 826. The cover 827 can also be provided with pull tabs 827*a* for easing the removal of the cover 827 from the tray 826. The tray 826 can also be provided with notches or cutouts 829 to assist the user in removing the cover 827 from the tray 826. The notches 829 provide a location for the user to grasp the pull tabs 827*a* on the cover 827 to remove the cover from the tray 826.

Figure 9A:
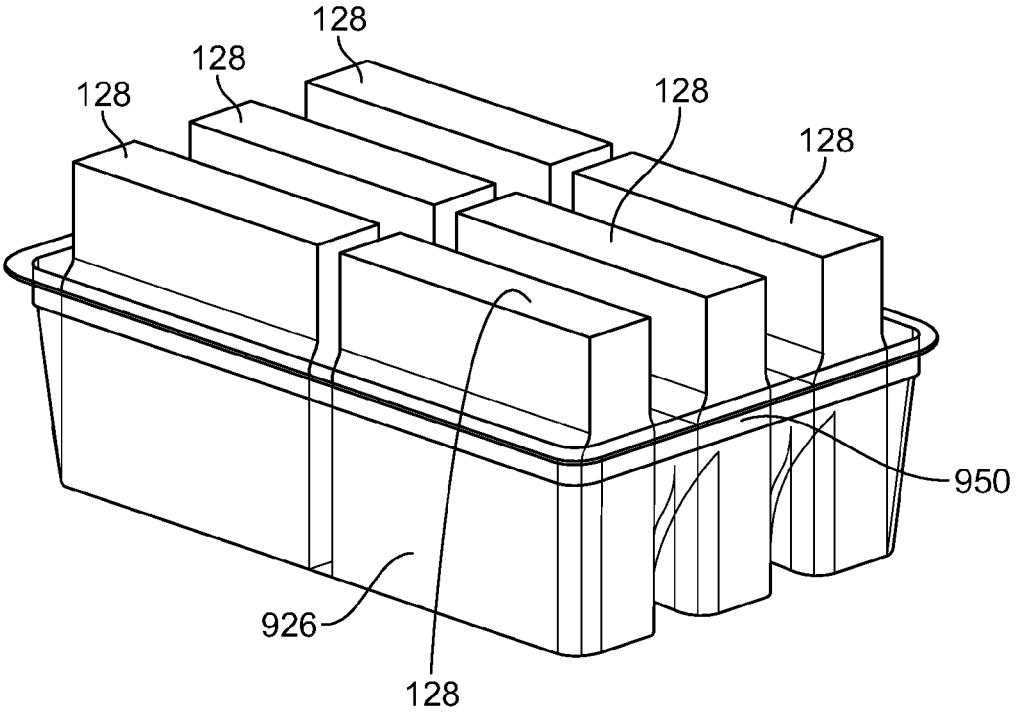
FIG. 9A shows a perspective view of another example tray loaded with cleaning pads.
Figure 9B:
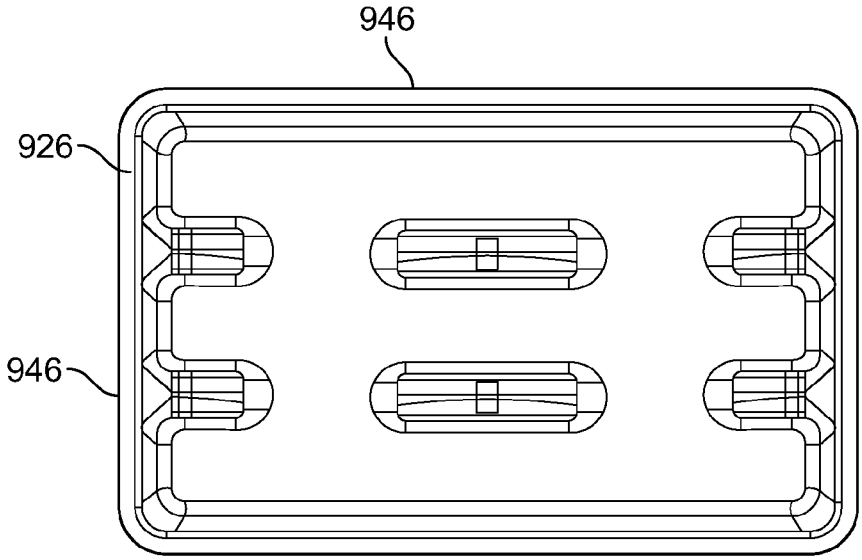
FIG. 9B shows a top view of the tray of FIG. 9A without cleaning pads.

Another tray arrangement is shown in FIGS. 9A and 9B where FIG. 9A shows a perspective view of the tray 926 loaded with cleaning pads 128, and FIG. 9B shows a top view of the tray 926 without the cleaning pads 128. The example shown in FIGS. 9A and 9B is similar to the example shown in relation to FIGS. 8A and 8B. However, as shown in FIGS. 9A and 9B, the tray 926 can be formed of formed of only one section with six slots for receiving the cleaning pads 128.

As shown in FIG. 9A, upper portions of the cleaning pads 128 can extend over the rim 950 of the tray 926. This exposes the upper portions of the cleaning pads 128 such that the user can easily grasp the cleaning pads 128 from the tray 926 with the wand 140. However, it is also contemplated that the rim 950 can extend to the top of the cleaning pads 128 such that the tray can be sealed with a cover in a blister package similar to the example shown in FIGS. 8A and 8B.

Figure 10A:
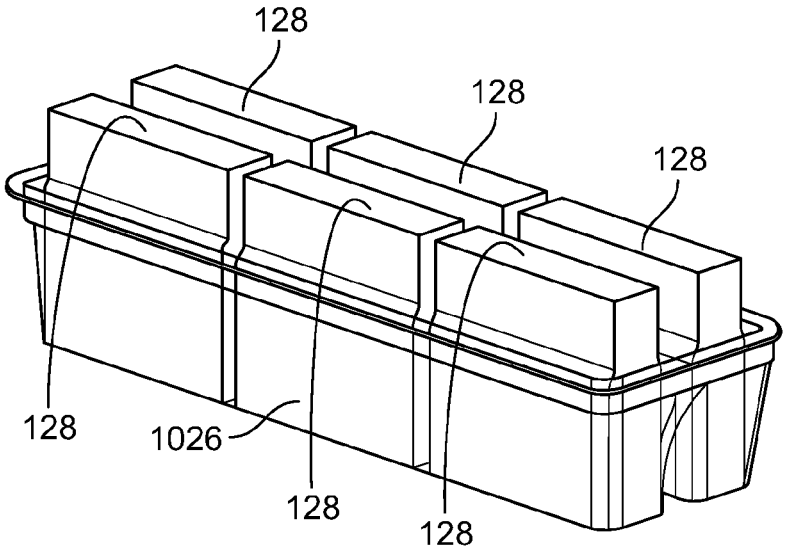
FIG. 10A shows a perspective view of another example tray loaded with cleaning pads.
Figure 10B:
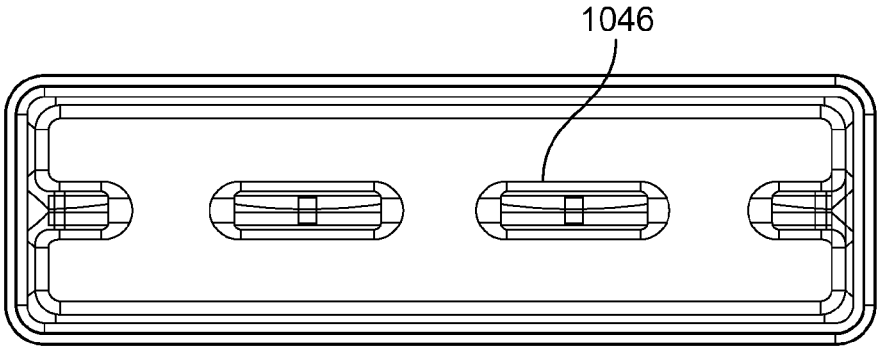
FIG. 10B shows a top view of the tray of FIG. 10A without cleaning pads.

Another tray arrangement is shown in FIGS. 10A and 10B, where FIG. 10A shows a perspective view of the example tray 1026 loaded with cleaning pads 128, and FIG. 10B shows a top view of the tray 1026 without the cleaning pads 128. In this example, the tray 1026 can be provided with six cleaning pads 128 aligned along the width of the cleaning pads 128. The ribs 1046 can be arranged along the center in an inside surface of the tray 1026 to provide for six slots for receiving the cleaning pads 128.

Figure 11A:
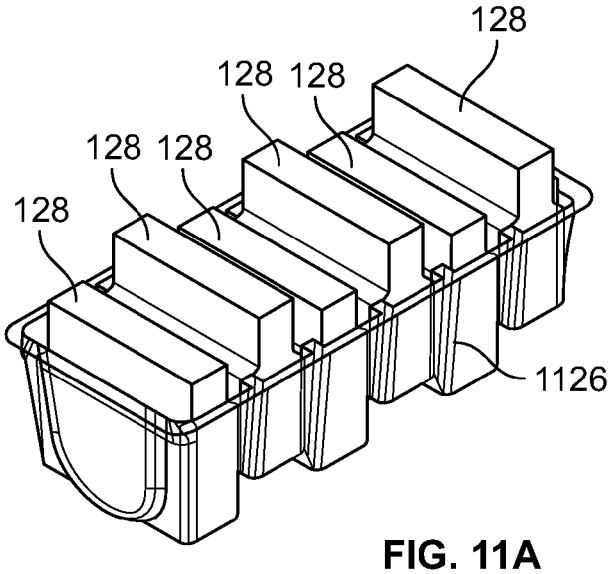
FIG. 11A shows a perspective view of another example tray loaded with cleaning pads.
Figure 11B:
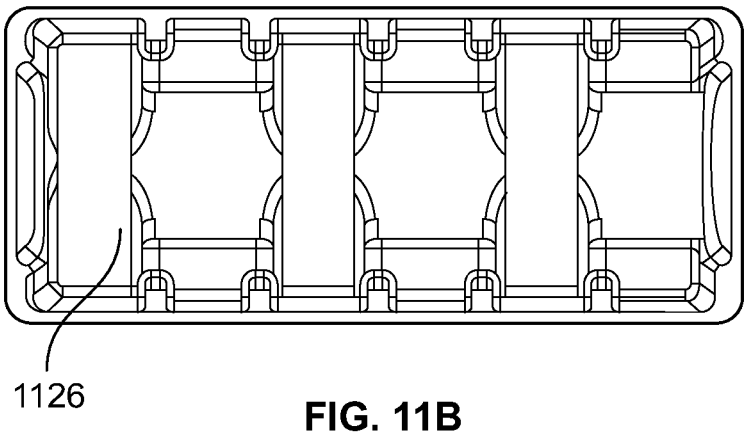
FIG. 11B shows a top view of the tray of FIG. 11A without cleaning pads.
Figure 11C:
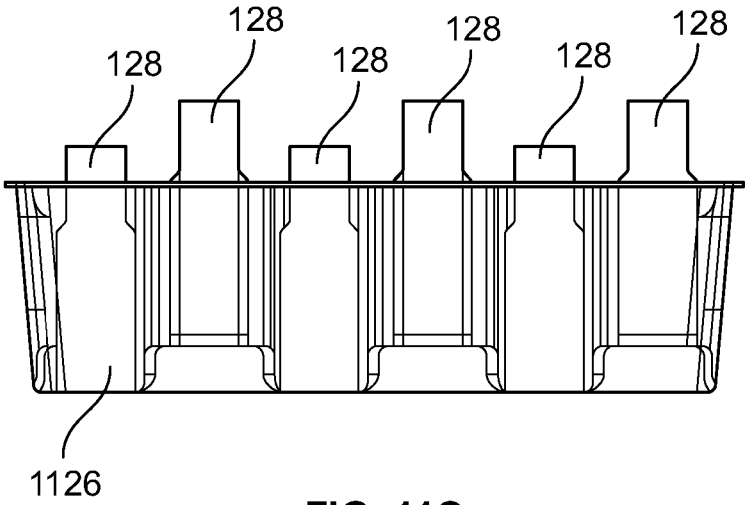
FIG. 11C shows a side view of the tray of FIG. 11A with cleaning pads.

Another tray arrangement is shown in FIGS. 11A-11C where FIG. 11A shows a perspective view of the tray 1126 loaded with cleaning pads 128, FIG. 11B shows a top view of the tray 1126 without the cleaning pads 128, and 11C shows a side view of the tray 1126 with cleaning pads 128. In this example, the tray 1126 can be provided with six cleaning pads 128. As shown in FIGS. 11A and 11C, the heights of the recesses for the cleaning pads 128 can be staggered or varied along the length of the tray 1126. The staggered arrangement of the cleaning pads 128 can make it easier for the user to grab the cleaning pads 128 with the wand 140.

Figure 12B:
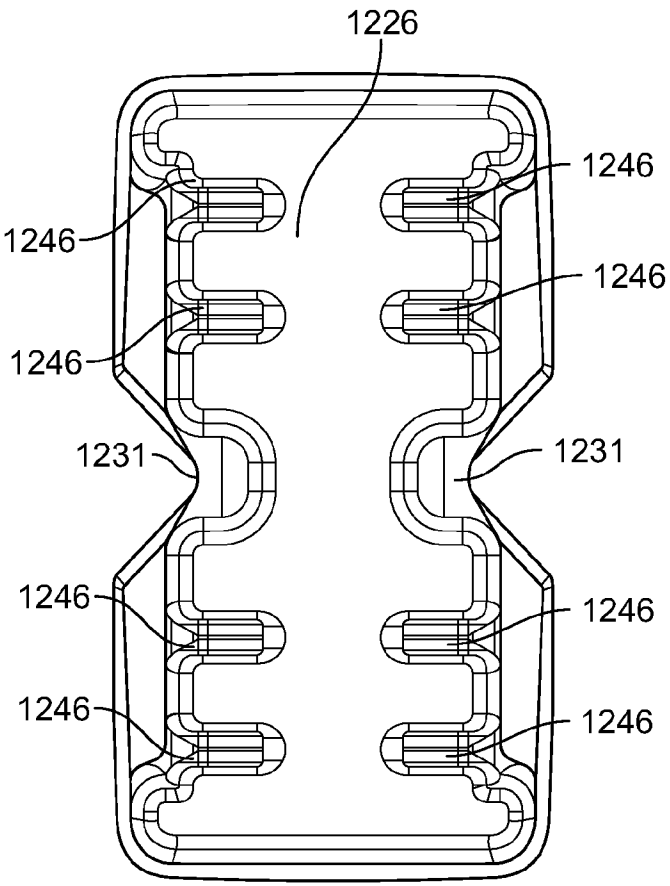
FIG. 12B shows a top view of the tray of FIG. 12A without cleaning pads.
Figure 12A:
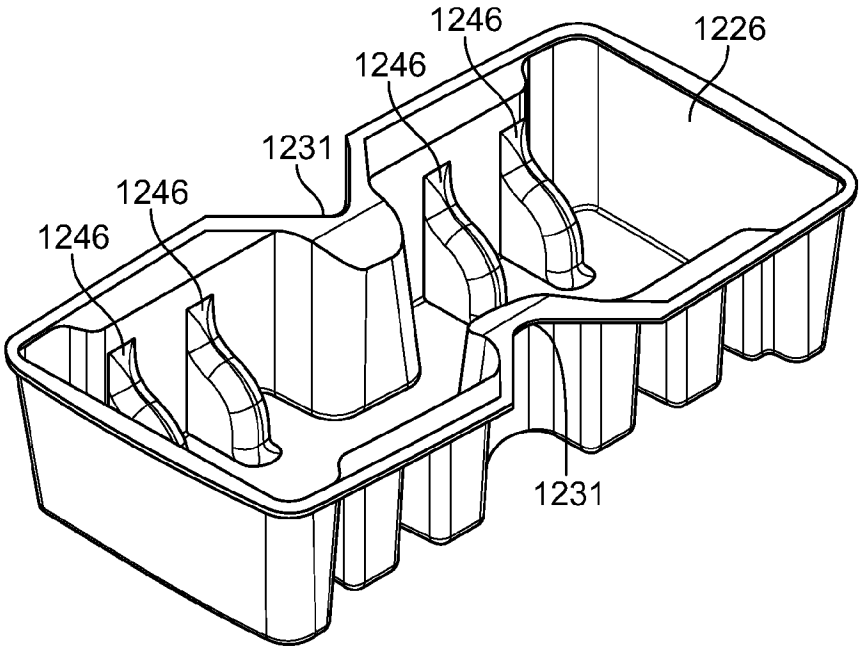
FIG. 12A shows a perspective view of another exemplary tray without cleaning pads.

Another tray arrangement is shown in FIGS. 12A and 12B where FIG. 12A shows a perspective view of the tray 1226 without the cleaning pads, and FIG. 12B shows a top view of the tray 1226 without the cleaning pads. The tray 1226 can be formed similar to the tray 126 discussed in relation to FIGS. 2A-2D. However, the tray 1226 can be provided with finger grab cutouts 1231 to provide the user with a grasping portion to remove the tray 1226 from the upper portions of the storage containers. The ribs 1246 and the finger grab cutouts 1231 can provide recesses to accommodate six cleaning pads in the tray 1226.

Figure 13A:
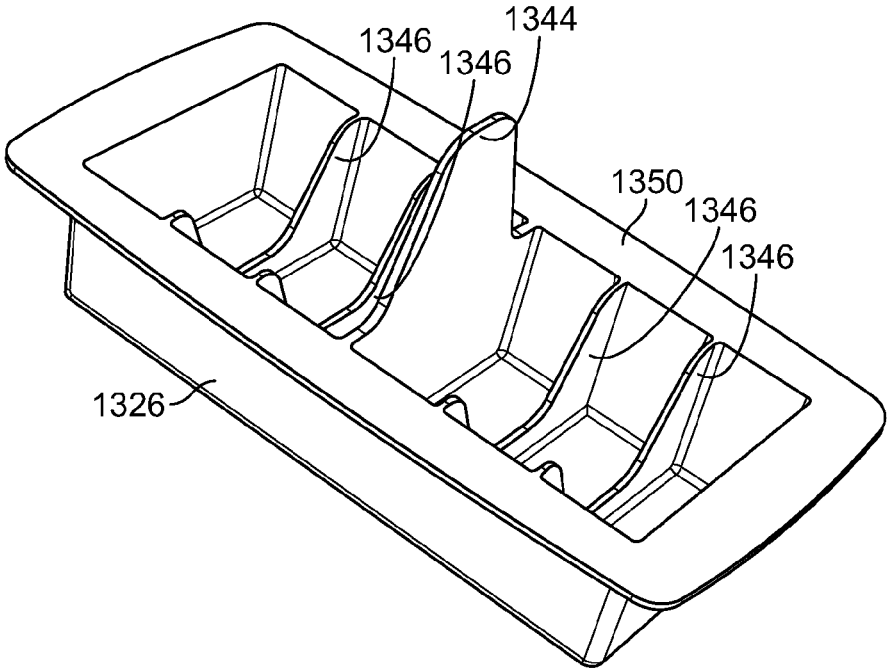
FIG. 13A shows a perspective view of another exemplary tray without cleaning pads.

FIG. 13A shows an exemplary tray 1326 without cleaning pads. This example has similar features and functions as the example discussed above in relation to FIGS. 2A-2D, in which like reference numerals refer to the same or similar elements in the examples above. However, the tray can be provided with an extended or elongated rim 1350 which extends around the periphery or perimeter of the tray 1326. Like in the above examples, the rim 1350 can provide a lower surface that can be placed into contact with projections 1325 or other structure to support the tray in the top portion of the storage container 1320.

The tray 1326 can be formed to reduce the amount of material and costs in manufacturing the tray. For example, the tray 1326 can be formed with thinner walls, and the tray 1326 can also be provided with thinner ribs 1346 which form the compartments 1348 for receiving the cleaning pads.

Figure 13B:
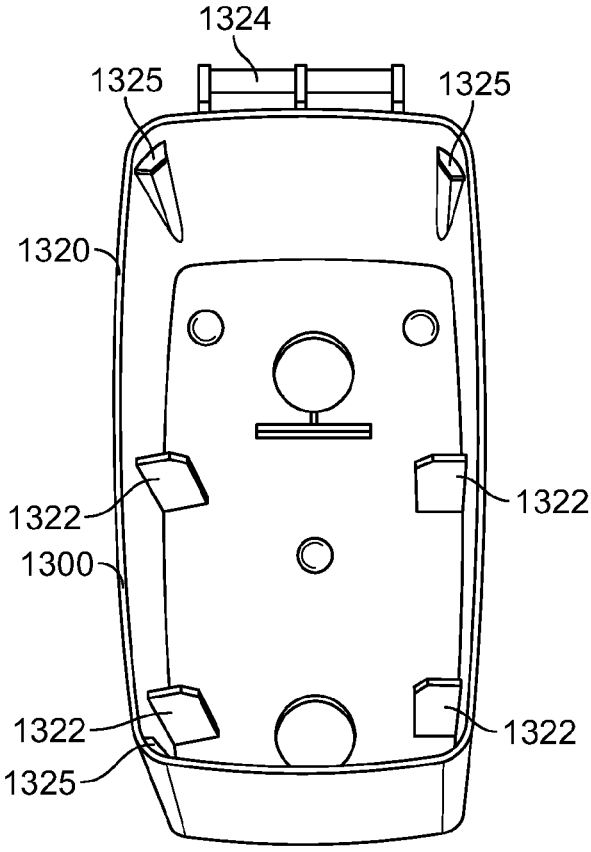
FIG. 13B shows a top perspective view of another example storage caddy with a lid, sleeve, and tray removed.
Figure 13D:
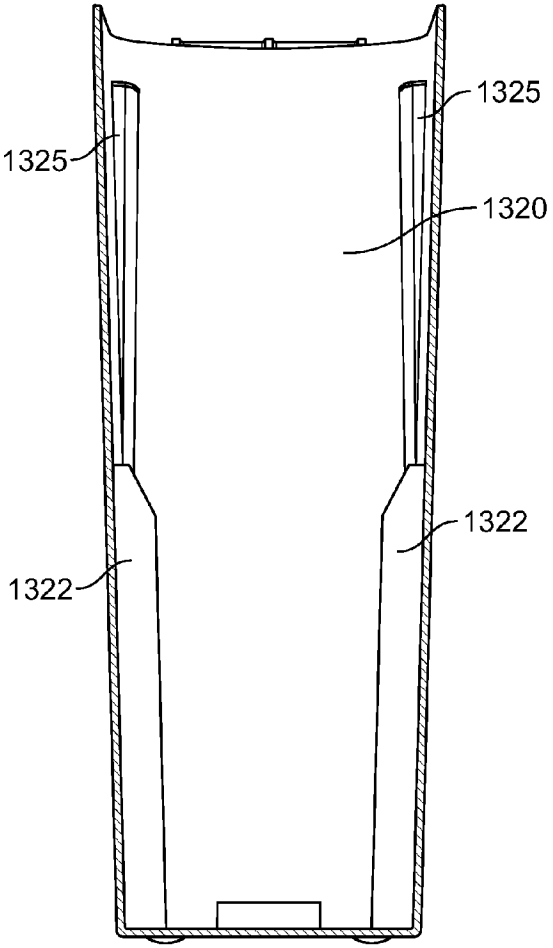
FIG. 13D is a cross-sectional view of FIG. 13B with a lid, sleeve, and tray removed.
Figure 13C:
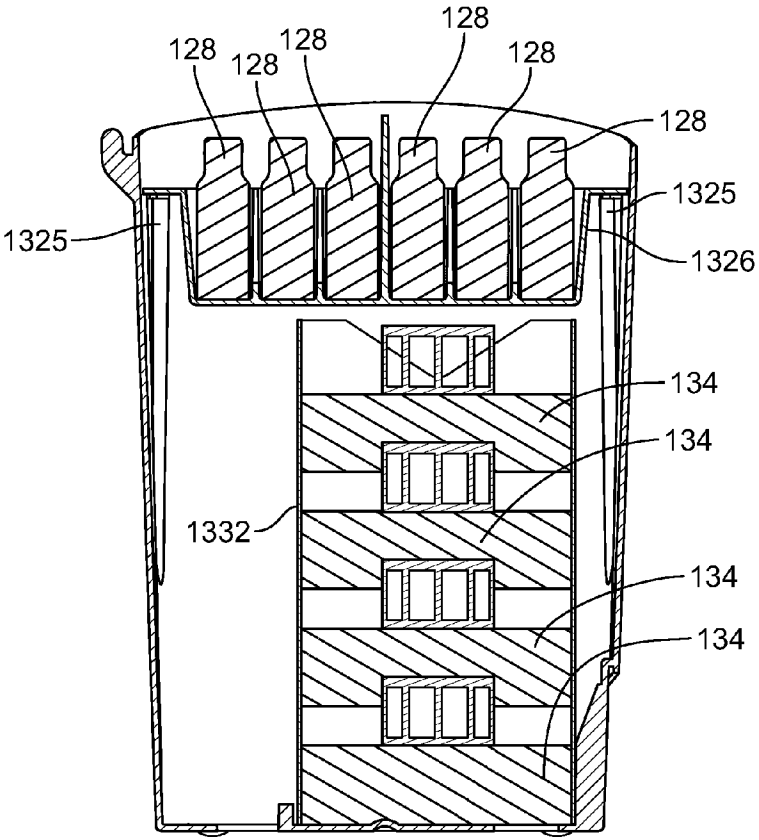
FIG. 13C shows a cross-sectional side view of the example storage caddy of FIG. 13B showing a sleeve and tray installed.
Figure 14C:
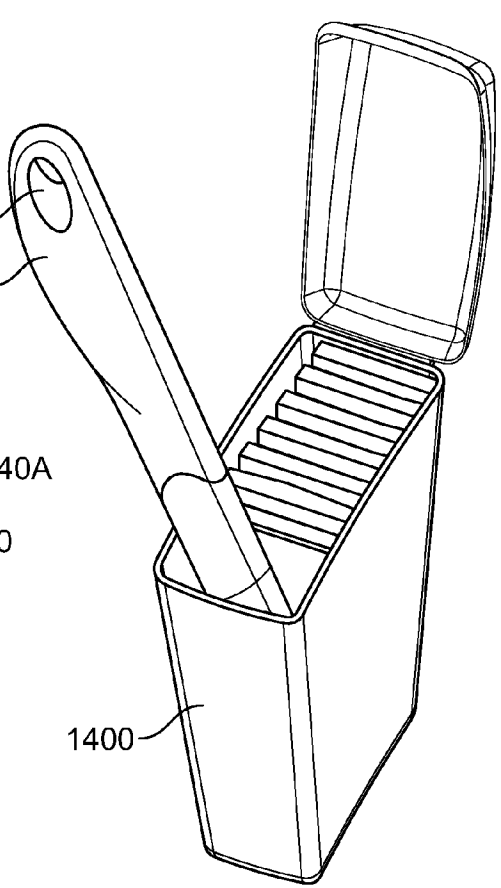
FIG. 14C shows a front perspective view of the example storage caddy of FIG. 14A with the lid in an opened position.
Figure 14B:
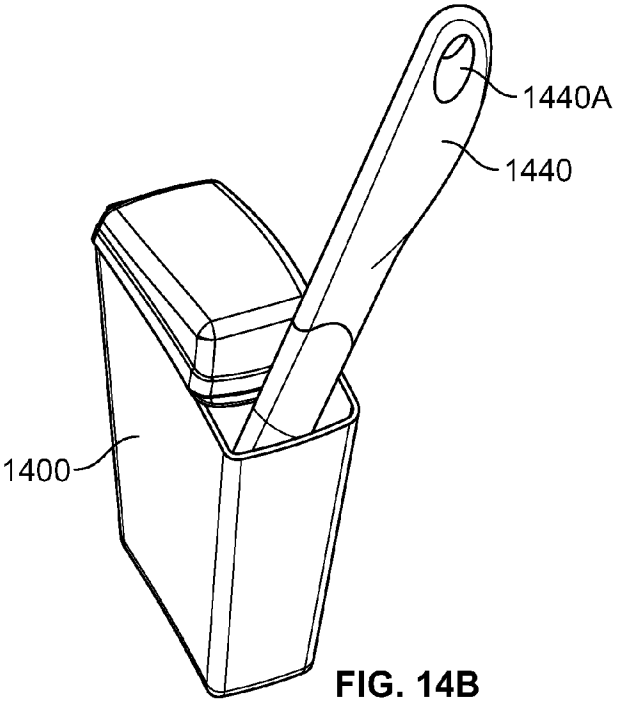
FIG. 14B shows a front perspective view of the example storage caddy of FIG. 14A.
Figure 14A:
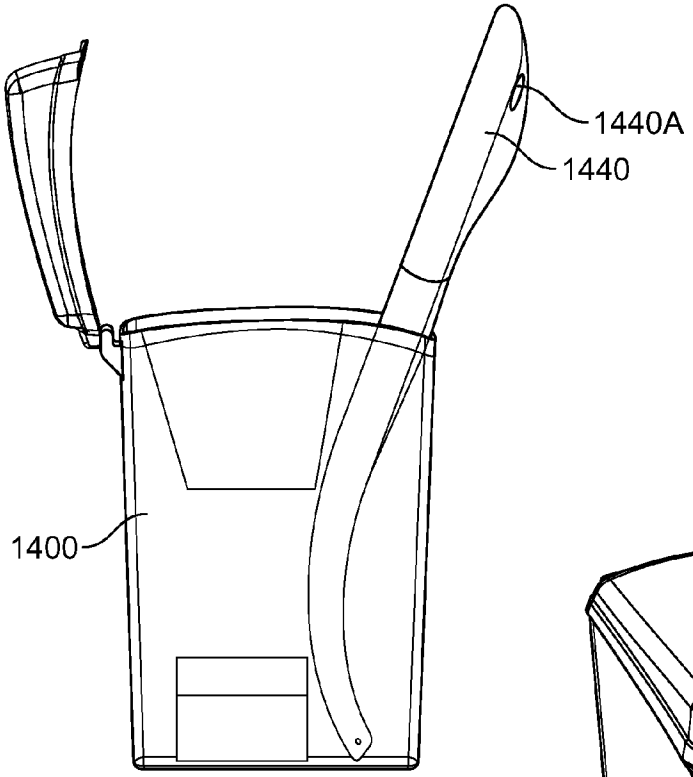
FIG. 14A shows a side view of another example storage caddy with the lid in an opened position in accordance with an aspect of the disclosure.
Figure 15C:
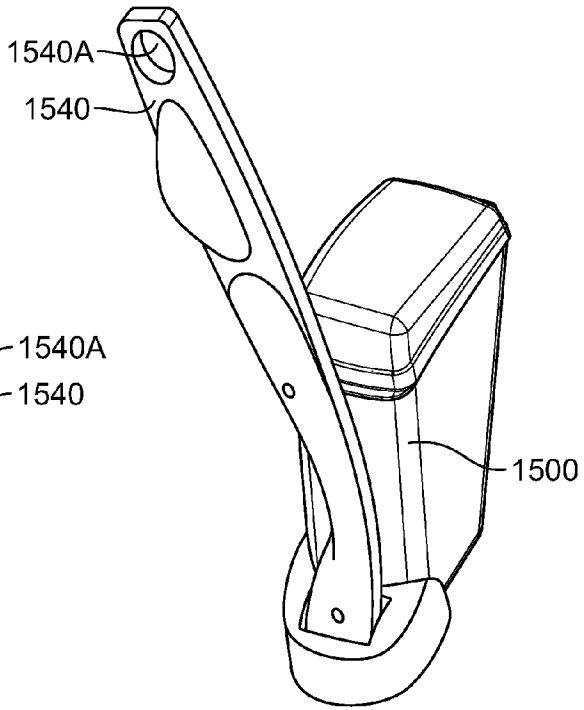
FIG. 15C shows a front perspective view of the example storage caddy of FIG. 15A with the lid in an opened position.
Figure 15B:
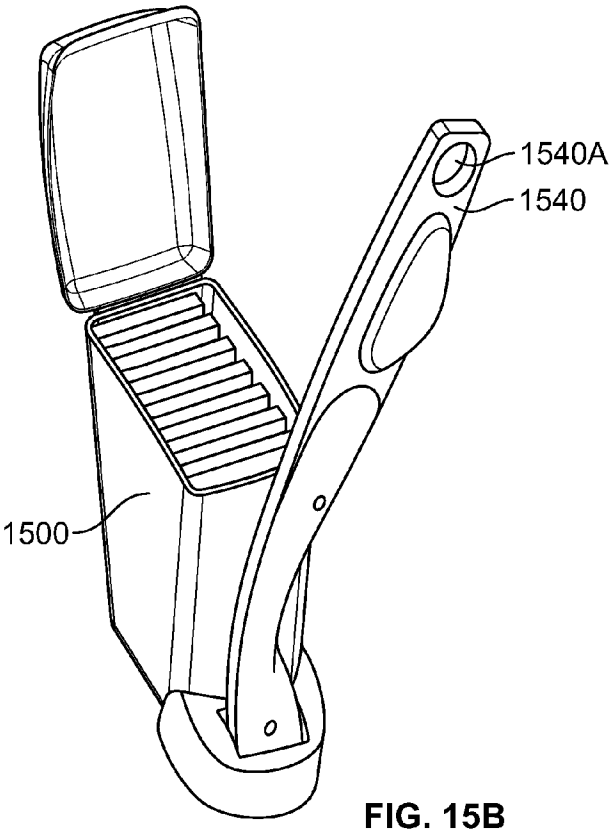
FIG. 15B shows a front perspective view of the example storage caddy of FIG. 15A.
Figure 15A:
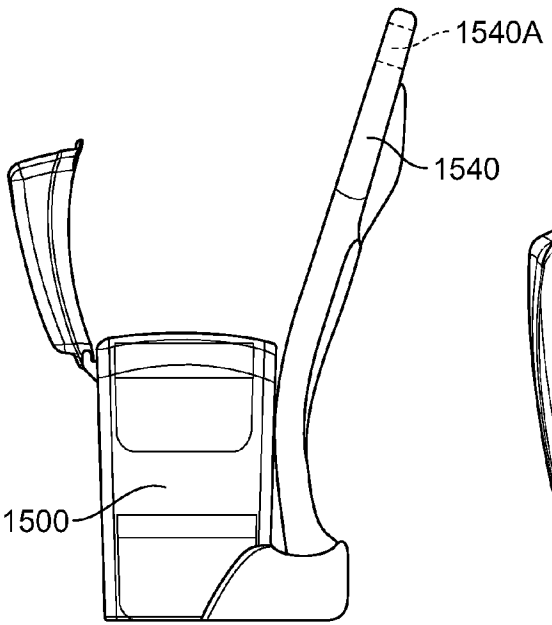
FIG. 15A shows a side view of another example storage caddy with the lid in an opened position in accordance with an aspect of the disclosure.

FIGS. 13B-13D depict another exemplary storage caddy 1300 for a cleaning implement and cleaning materials, which has similar features and functions as the example discussed above in relation to FIGS. 1A-1G in which like reference numerals refer to the same or similar elements. However, in this example, the weight and material cost of the storage container 1320 can be reduced. For example, the storage container 1320 can be provided with fewer ribs or projections 1322 in the interior of the container for receiving the sleeve containing cleaning pads. In this example, four ribs or projections 1322 can be provided instead of nine. Like in the above examples, the storage caddy 1300 can be configured to receive tray 1326. In particular, the storage container 1320 can include four projections 1325 in the upper portion of the container 1320 for receiving the tray 1326. The projections 1325 provide surfaces for receiving the bottom area of the rim 1350. In this way, the storage caddie can include a first set of projections 1325 for receiving the tray 1326 containing a first set of cleaning pads 128 and a second set of projections 1322 for receiving a sleeve 1332 containing a second set of cleaning pads 134 similar to the examples discussed above.

The storage caddy 1300 can include a base or holder (not shown) similar to the base 110 shown above in FIG. 1A for holding a wand 140 (shown in FIG. 4). Also the storage container 1320 can be used for housing cleaning materials, e.g., toilet gels, refills, cleaning pads, etc. Similar to the examples discussed above, the storage container 1320 can also include a lid (not shown) connected to the container 1320 by a hinge 1324 or other suitable connection such that during use, the user can open the lid and access cleaning pads when located in the storage container 1320 with the wand 140.

Also like the example shown above in FIGS. 1A-1G, a first set of cleaning pads can be arranged in an upper portion of the storage container 1320 in the tray 1326 above a second set of cleaning pads located in a lower portion of the storage container 1320 and held into place by the ribs or projections 1322. Also, like in the above examples, the first set of cleaning pads can have a first cleaning efficacy and the second set of cleaning pads can have a second cleaning efficacy that is different than the first set of cleaning pads.

Additionally, the position of the wand may play a role in determining how often the cleaning pads are used, for example, positioning the wand towards the front or the back of the storage caddie. Placing the wand up front, rather in the back, may make the wand easy to grab which is a required to start the process of attaching the cleaning pads to the wand and, thus, the cleaning process. Also configuring the wand such that it extends toward the user may impact how often the wand and storage caddy is used. FIGS. 14A-15C show example storage caddies 1400, 1500 that have similar features and functions to the examples discussed above. However, as shown in FIGS. 14A-15C, the storage caddies 1400, 1500 and the wands are configured such that the ends of the wands 1440, 1540 extend toward the user in the front of the storage caddies 1400, 1500 to make the wands easier to grab and, thus, promote a higher occurrence of cleaning. In addition, the wands may include an optional hole 1440*a*, 1540*a* for hanging the wands 1440, 1450 when not in use.

In one example, a storage caddy for a cleaning implement can include a holder for receiving a wand and a storage container having a lid connected to the storage container by a hinge. The holder can be located on or inside the storage container.

The storage caddy may also include a first set of cleaning pads and a tray for holding the first set of cleaning pads. A second set of cleaning pads and a sleeve for holding the second set of cleaning pads can also be included. The first set of cleaning pads can be arranged in an upper portion of the storage container above the second set of cleaning pads, and the second set of cleaning pads can be located in a lower portion of the storage container such that a user can select one of the first set of cleaning pads or one of the second set of cleaning pads with the wand and without the user directly touching the first set of cleaning pads or the second set of cleaning pads.

The storage container can also include at least one projection for receiving the tray or a plurality of projections for receiving the tray. The plurality of projections can form a first plane, and the tray can include a rim. The rim can sit on the first plane formed by the plurality of projections. The plurality of projections can be tapered to accommodate the tray in the upper portion of the storage container. The plurality of projections can extend around an inside perimeter of the storage container.

The sleeve can be held in place in the storage container by the plurality of projections. The plurality of projections can form a first set of parallel planes and the sleeve can form a second set of parallel planes. The distance between the first set of parallel planes can be less than a distance between the second set of parallel planes to secure the sleeve in the storage container. The storage container can be formed with a floor projection and the floor projection can be configured to engage a face of the sleeve to assist in locating the sleeve in place in the storage container.

Also, the lid can be placed on the upper portion of the storage container and can be configured to expose the first set of cleaning pads. The tray can further include a handle which can be grasped by a user to remove the tray from the storage container to expose the second set of cleaning pads. The first set of cleaning pads can be configured to be flushable.

In another example, a storage caddy for a cleaning implement may include a holder configured to receive a wand, a storage container having a lid, a set of cleaning pads, and a tray for holding the set of cleaning pads. The set of cleaning pads can be arranged in an upper portion of the storage container such that a user can select one of the set of cleaning pads without the user directly touching the set of cleaning pads.

In another aspect, the storage container may include a plurality of projections for receiving the tray, and the plurality of projections can form a first plane and the tray may include a rim, and the rim can sit on the first plane formed by the plurality of projections. The plurality of projections can be tapered to accommodate the tray in an upper portion of the container.

In another aspect, the storage caddy can include a second set of cleaning pads and a sleeve for holding the second set of cleaning pads. The sleeve can be held in place in the storage container by the plurality of projections. The plurality of projections can form a first set of parallel planes, and the sleeve can form a second set of parallel planes. The distance between the first set of parallel planes can be less than a distance between the second set of parallel planes to secure the sleeve in the container. The lid can be placed on the upper portion of the storage container and can also be configured to expose the set of cleaning pads. The tray can further include a handle that can be configured to be grasped by the user to remove the tray from the storage container to expose the second set of cleaning pads. The first set of cleaning pads can be configured to be flushable. The holder can also be located on or inside the storage container.

In another example, a toilet caddy may include a cleaning implement, a holder configured to receive the cleaning implement when not in use, a container defining a storage receptacle configured to receive cleaning pads associated with the cleaning implement and at least one additional cleaning material. The toilet caddie may optionally also include a lid for at least partially covering the storage receptacle, and the lid can be selectively moveable between an open first position and a closed second position. The toilet caddie may also include a tray for holding a first array of cleaning pads, and the tray can be received within an upper portion of the storage receptacle. A storage area can be located within the storage receptacle and at least partially under the tray for receiving the at least one additional cleaning material. The tray can be configured to hold the first array of cleaning pads in such a manner that, when the lid is in the open first position, a user can secure a cleaning pad from the first array of cleaning pads onto the cleaning implement without the user directly touching the cleaning pad.

In one example, the tray can be removable such that the user can selectively remove the tray from the storage receptacle for at least one of replenishing the tray when depleted of cleaning pads, replacing the tray when depleted of cleaning pads and accessing the at least one additional cleaning material. The tray can include a handle configured to be grasped by the user to remove the tray from the container. The tray can space apart each cleaning pad of the first array of cleaning pads in a substantially horizontal direction. The tray can include a peripheral rim configured to engage the container for supporting the tray in the upper portion of the storage receptacle. The container can include a first set of projections that define a plane upon which the peripheral rim of the tray sits. The container can also include a second set of projections configured to form an interference fit with a removable sleeve containing a second array of cleaning pads.

In one example, the container can be formed with a floor projection, and the floor projection can be configured to engage the removable sleeve to assist in locating the removable sleeve in place in the container. The first set of projections can be tapered to accommodate the tray in the upper portion of the storage receptacle and can be configured to form an interference fit with a removable sleeve containing a second array of cleaning pads. The holder can be connected to the container and located within the storage receptacle. The holder can be connected to the container and located outside of the storage receptacle.

In another example, a storage caddy for housing cleaning pads associated with a cleaning implement may include a container defining a storage receptacle, a first tier of cleaning pads supported within the storage receptacle and configured to be selectively secured to the cleaning implement by a user. The first tier of cleaning pads may provide the user with a first cleaning efficacy. A second tier of cleaning pads can be supported within the storage receptacle and may be configured to be selectively secured to the cleaning implement by a user. The second tier of cleaning pads can provide the user with a second cleaning efficacy that is different than the first cleaning efficacy. The first tier of cleaning pads and the second tier of cleaning pads can be supported within the storage receptacle such that a user can secure the cleaning pads onto the cleaning implement without directly touching the cleaning pads. The first tier of cleaning pads can be supported within the storage receptacle at least partially above the second tier of cleaning pads. The first tier of cleaning pads can be intended for touch-up cleaning situations and the second tier of cleaning pads can be intended for heavier cleaning situations. The first tier of cleaning pads can be configured to be flushable and disposable after use, while the second tier of cleaning pads can be configured to be disposable but not flushable after use. The first tier of cleaning pads can be offset from each other in a horizontal direction within a tray, and the second tier of cleaning pads can be offset from each other in a vertical direction within a sleeve.

In another example, a method can include providing a holder configured to receive a wand, providing a storage container with a first set of cleaning pads and a second set of cleaning pads, storing the first set of cleaning pads in a tray and storing a second set of cleaning pads in a sleeve in the container, and arranging the first set of cleaning pads in an upper portion of the storage container above the second set of cleaning pads such that the wand can receive one of the first set of cleaning pads or one of the second set of cleaning pads without a user directly touching the first set of cleaning pads or the second set of cleaning pads.

The method may also include providing the storage container with a plurality of projections for receiving the tray and holding the sleeve in place in the storage container by the plurality of projections. The method may also include placing a lid on the upper portion of the storage container such that the lid exposes the first set of cleaning pads upon a user opening the lid and providing a handle configured to be grasped by a user to remove the tray from the storage container to expose the second set of cleaning pads.

The present invention is disclosed above and in the accompanying drawings with reference to a variety of examples. The purpose served by the disclosure, however, is to provide examples of the various features and concepts related to the invention, not to limit the scope of the invention. One skilled in the relevant art will recognize that numerous variations and modifications may be made to the examples described above without departing from the scope of the present invention.

What is claimed is:

1. A toilet caddy comprising:

a cleaning implement;

a holder configured to receive the cleaning implement when not in use;

a container defining a storage receptacle configured to receive cleaning pads associated with the cleaning implement and at least one additional cleaning material;

a lid for at least partially covering the storage receptacle, the lid being selectively moveable between an open first position and a closed second position;

a tray for holding a first array of cleaning pads at an orientation such that a user can selectively secure any one of the cleaning pads within the first array of cleaning pads to the cleaning implement without first removing another cleaning pad within the first array of cleaning pads, the tray being received within an upper portion of the storage receptacle;

a storage area located within the storage receptacle and at least partially under the tray for receiving the at least one additional cleaning material;

wherein the tray holds the first array of cleaning pads in such a manner that, when the lid is in the open first position, a user can secure the cleaning pad from the first array of cleaning pads onto the cleaning implement without the user directly touching the cleaning pad.

2. The toilet caddy of claim 1 wherein the tray is removable such that the user can selectively remove the tray from the storage receptacle for at least one of replenishing the tray when depleted of cleaning pads, replacing the tray when depleted of cleaning pads and accessing the at least one additional cleaning material.

3. The toilet caddy of claim 2 wherein the tray comprises a handle configured to be grasped by the user to remove the tray from the container.

4. The toilet caddy of claim 2 wherein the tray spaces apart each cleaning pad of the first array of cleaning pads in a substantially horizontal direction.

5. The toilet caddy of claim 2 wherein the tray comprises a peripheral rim configured to engage the container for supporting the tray in the upper portion of the storage receptacle.

6. A toilet caddy comprising:

a cleaning implement;

a holder configured to receive the cleaning implement when not in use;

a container defining a storage receptacle configured to receive cleaning pads associated with the cleaning implement and at least one additional cleaning material;

a lid for at least partially covering the storage receptacle, the lid being selectively moveable between an open first position and a closed second position;

a tray for holding a first array of cleaning pads, the tray being received within an upper portion of the storage receptacle;

a storage area located within the storage receptacle and at least partially under the tray for receiving the at least one additional cleaning material;

wherein the tray holds the first array of cleaning pads in such a manner that, when the lid is in the open first position, a user can secure a cleaning pad from the first array of cleaning pads onto the cleaning implement without the user directly touching the cleaning pad;

wherein the tray is removable such that the user can selectively remove the tray from the storage receptacle for at least one of replenishing the tray when depleted of cleaning pads, replacing the tray when depleted of cleaning pads and accessing the at least one additional cleaning material; and wherein the container comprises a first set of projections that define a plane upon which the peripheral rim of the tray sits.

7. The toilet caddy of claim 6 wherein the container further comprises a second set of projections configured to form an interference fit with a removable sleeve containing a second array of cleaning pads.

8. The toilet caddy of claim 7 wherein the container is formed with a floor projection and wherein the floor projection is configured to engage the removable sleeve to assist in locating the removable sleeve in place in the container.

9. The toilet caddy of claim 6 wherein the first set of projections are tapered to accommodate the tray in the upper portion of the storage receptacle and are configured to form an interference fit with a removable sleeve containing a second array of cleaning pads.

10. The toilet caddy of claim 1 wherein the holder is connected to the container and located within the storage receptacle.

11. The toilet caddy of claim 1 wherein the holder is connected to the container and located outside of the storage receptacle.

12. A storage caddy for housing cleaning pads associated with a cleaning implement, the storage caddy comprising:

a container defining a storage receptacle;

a first tier of cleaning pads supported within the storage receptacle and configured to be selectively secured to the cleaning implement by a user, the first tier of cleaning pads providing the user with a first cleaning efficacy; and a second tier of cleaning pads supported within the storage receptacle and configured to be selectively secured to the cleaning implement by a user, the second tier of cleaning pads providing the user with a second cleaning efficacy;

wherein the second tier of cleaning pads includes at least one of a substrate and a cleaning composition that is different than at least one of a substrate and a cleaning composition of the first tier of cleaning pads so that the second cleaning efficacy is different than the first cleaning efficacy;

wherein the first tier of cleaning pads and the second tier of cleaning pads are supported within the storage receptacle such that a user can secure the cleaning pads onto the cleaning implement without directly touching the cleaning pads.

13. The storage caddy of claim 12 wherein the first tier of cleaning pads are supported within the storage receptacle at least partially above the second tier of cleaning pads.

14. The storage caddy of claim 13 wherein the first tier of cleaning pads are intended for touch-up cleaning situations and the second tier of cleaning pads are intended for heavier cleaning situations.

15. The storage caddy of claim 13 wherein the first tier of cleaning pads are configured to be flushable and disposable after use, while the second tier of cleaning pads are configured to be disposable but not flushable after use.

16. The storage caddy of claim 13 wherein the first tier of cleaning pads are offset from each other in a horizontal direction within a tray and the second tier of cleaning pads are offset from each other in a vertical direction within a sleeve.

17. The storage caddy of claim 12 wherein a substrate of the first tier of cleaning pads is different than a substrate of the second tier of cleaning pads.

18. The storage caddy of claim 12 wherein a cleaning composition of the first tier of cleaning pads is different than a cleaning composition of the second tier of cleaning pads.

19. The storage caddy of claim 12 wherein a user must remove the first tier of cleaning pads from the receptacle in order to access the second tier of cleaning pads.

20. The storage caddy of claim 12 further comprising a holder configured to receive the cleaning implement when not in use.

* * * * *